US005995063A

United States Patent [19]

Somoza et al.

[11] Patent Number: 5,995,063

[45] Date of Patent: Nov. 30, 1999

[54] ANTENNA STRUCTURE

[75] Inventors: Vincent Somoza, Kanata; Paul McDonald, Nepean, both of Canada

[73] Assignee: Nortel Networks Corporation, Montreal, Canada

[21] Appl. No.: 09/133,211

[22] Filed: Aug. 13, 1998

[51] Int. Cl.[6] ..... H01Q 1/12

[52] U.S. Cl. ..... 343/890; 343/874; 343/883; 343/892; 52/40; 52/111; 52/115

[58] Field of Search ..... 343/890, 874, 343/877, 883, 892, 900; 52/111, 115, 121, 40

[56] References Cited

U.S. PATENT DOCUMENTS

| | | | |
|---|---|---|---|
| 3,327,437 | 6/1967 | Rush | 52/111 |
| 4,062,156 | 12/1977 | Roth | 52/111 |
| 4,356,498 | 10/1982 | Pollard | 343/890 |
| 4,426,650 | 1/1984 | Korsen | 343/903 |
| 4,647,941 | 3/1987 | Myer | 343/792 |
| 5,537,125 | 7/1996 | Harrell, Jr. et al. | 343/878 |
| 5,570,546 | 11/1996 | Butterworth et al. | 52/111 |
| 5,581,958 | 12/1996 | Cote | 52/40 |

FOREIGN PATENT DOCUMENTS

| | | | |
|---|---|---|---|
| 1041270 | 10/1978 | Canada | 20/112 |
| 1252197 | 4/1989 | Canada | 351/50 |
| 0106069 | 4/1984 | European Pat. Off. | H01Q 1/10 |
| 0269893 | 6/1988 | European Pat. Off. | H01Q 1/34 |
| 0791976 | 8/1997 | European Pat. Off. | H01Q 1/44 |
| 3129661 | 7/1981 | Germany | 12/18 |
| 3129661 | 2/1983 | Germany | E04H 12/18 |
| 2289827 | 5/1994 | United Kingdom | 7/30 |
| 2289827 | 11/1995 | United Kingdom | H04Q 7/30 |

OTHER PUBLICATIONS

HV 47766, Derwent Patent Search / Derwent Record #007859657 / Title: Microwave–type periscope antenna unit / Date: Mar. 28, 1989 / Assignee: Orion Radio Villamos Vallalat (ORIO).

SU 885513, Derwent Patent Search / Derwent Record #003376874 / Title: Mobile antenna tower / Date: May 12, 1981 / Assignee: Communic Min Des (Comm–R).

*Primary Examiner*—Don Wong
*Assistant Examiner*—James Clinger

[57] ABSTRACT

The present invention relates to radio communications and in particular to antenna structures. There is a growing demand in the radio communication system market to reduce the size and cost of radio communication sites and to reduce the maintenance costs involved. Many radio communication sites are also costly and difficult to maintain especially when dealing with components of the antenna structures which are located near the top of the antenna structures. The present invention attempts to address these problems. The present invention provides an antenna structure comprising a hollow antenna mast having an inside and an outside, a movable module disposed inside the hollow antenna mast and a lifting mechanism. The movable module has at least one antenna and/or at least one RF module. The a lifting mechanism permits the raising and lowering of the movable module inside the hollow antenna mast. Furthermore, the communications equipment can be placed inside the hollow antenna mast.

58 Claims, 28 Drawing Sheets

ANTENNA STRUCTURE

FIELD OF INVENTION

The present invention relates to radio communications and in particular to antenna structures.

BACKGROUND OF THE INVENTION

There is a growing demand in the radio communications system market to reduce the size of radio communication sites. A radio communication site typically comprises an antenna structure and a base station structure. The base station structure typically houses communications equipment. For example, in cellular radio communications systems, the communications equipment typically consists of a radio transceiver, a digital controller for site management, a power supply and backhaul equipment to carry data and traffic to and from a network controller located away from the communication site. The base station structure typically adjoins the antenna structure or is located very near to the antenna structure. A cable connects the antenna with the radio transceiver in the base station structure.

Many radio communication sites are costly to install and require a substantial amount of real estate to be purchased or leased. Many radio communication sites are also costly and difficult to maintain especially when dealing with components of the antenna structures which are located near the top of the antenna structures (e.g. antennas, preamplifiers, etc.).

The base station structures typically require expensive heating and cooling systems to maintain proper environmental conditions for the communications equipment. Furthermore, the base station structures are typically "vandal proofed". The vandal proofing and the heating and cooling systems add to the cost of a radio communication site. In addition, the requirement for heating and cooling systems reduces the reliability of the communications equipment.

Furthermore, especially at VHF and UHF frequencies, there is typically a great deal of transmission loss in the cable that connects the antenna with the radio transceiver housed in the base station structure. Consequently, a larger radio transceiver with a higher power output is typically required to compensate for the transmission loss in the cable. Since the larger radio transceiver typically generates more heat, a larger cooling system is typically required. The larger radio transceiver and the larger cooling system add to the cost of the radio communication site.

Moreover, many radio communication sites create visual clutter and are not very aesthetically appealing. For example, in cellular radio communication systems, many antenna structures use lattice towers. The base station structures typically use environmentally controlled huts, 400 to 800 square feet in size. Both the base station structures and the antenna structures are typically surrounded by chain link and razor wire fencing.

Not surprisingly, due the scale and visual clutter of many proposed radio communication sites, service providers often experience strong community resistance to the erection of these proposed radio communication sites. The strong community resistance often creates delays for the service provider and may even cause the cancellation of necessary governmental permits for the proposed radio communication sites.

U.K. patent application 2,289,827 published on Nov. 29, 1995 in the name of Vernon Julian Fernandes as inventor, discloses an integrated base station and antenna mast. In an attempt to address some of the problems mentioned above, the communications equipment (including radio transceivers) is housed inside a hollow mast. Consequently, the need for a separate base station structure is eliminated. Convenient means to cool the communications equipment is provided by internal convection, conduction through the body of the mast and radiation. However, the U.K. patent application does not address the high cost of maintaining communication sites which have components, such as antennas and RF modules (or radio transceivers), located near the top of the antenna structure, nor does it address the transmission losses in the cable connecting the radio transceiver with the antenna.

SUMMARY OF THE INVENTION

It is an object of the present invention to provide an improved antenna structure in which the above mentioned problems are obviated or mitigated.

These and other objects will be apparent from the detailed specification and the accompanying drawings.

In accordance with one aspect of the present invention, there is provided an antenna structure comprising a hollow antenna mast having an inside and an outside, a movable module disposed inside said hollow antenna mast and lifting means. The movable module has at least one antenna, at least one RF module and at least one RF transmission means connected to the at least one antenna and the at least one RF module. The lifting means permit the raising and lowering of the movable module inside the hollow antenna mast between a lower position and an upper position.

In accordance with another aspect of the present invention, there is provided an antenna structure comprising a hollow antenna mast having an inside and an outside, at least one antenna attached to the hollow antenna mast, a movable module having at least one RF module, RF transmission means connected to the at least one RF module and lifting means. The movable module is disposed inside the hollow antenna mast. The lifting means permit the raising and lowering of the movable module inside the hollow antenna mast between a lower position and an upper position. When the movable module is in the upper position, the RF transmission means mate with the at least one antenna.

In accordance with another aspect of the present invention, there is provided an antenna structure comprising a hollow antenna mast having an inside and an outside, a movable module having at least one antenna and lifting means. The movable module is disposed inside the hollow antenna mast. The lifting means permit the raising and lowering of the movable module inside the hollow antenna mast between a lower position and an upper position.

BRIEF DESCRIPTION OF THE DRAWINGS

A detailed description of a preferred embodiment is provided below with the reference to the following drawings, in which.

It should be noted that some of the drawings are not drawn to the same scale.

DETAILED DESCRIPTION OF THE PREFERRED EMBODIMENT

Figure 1:
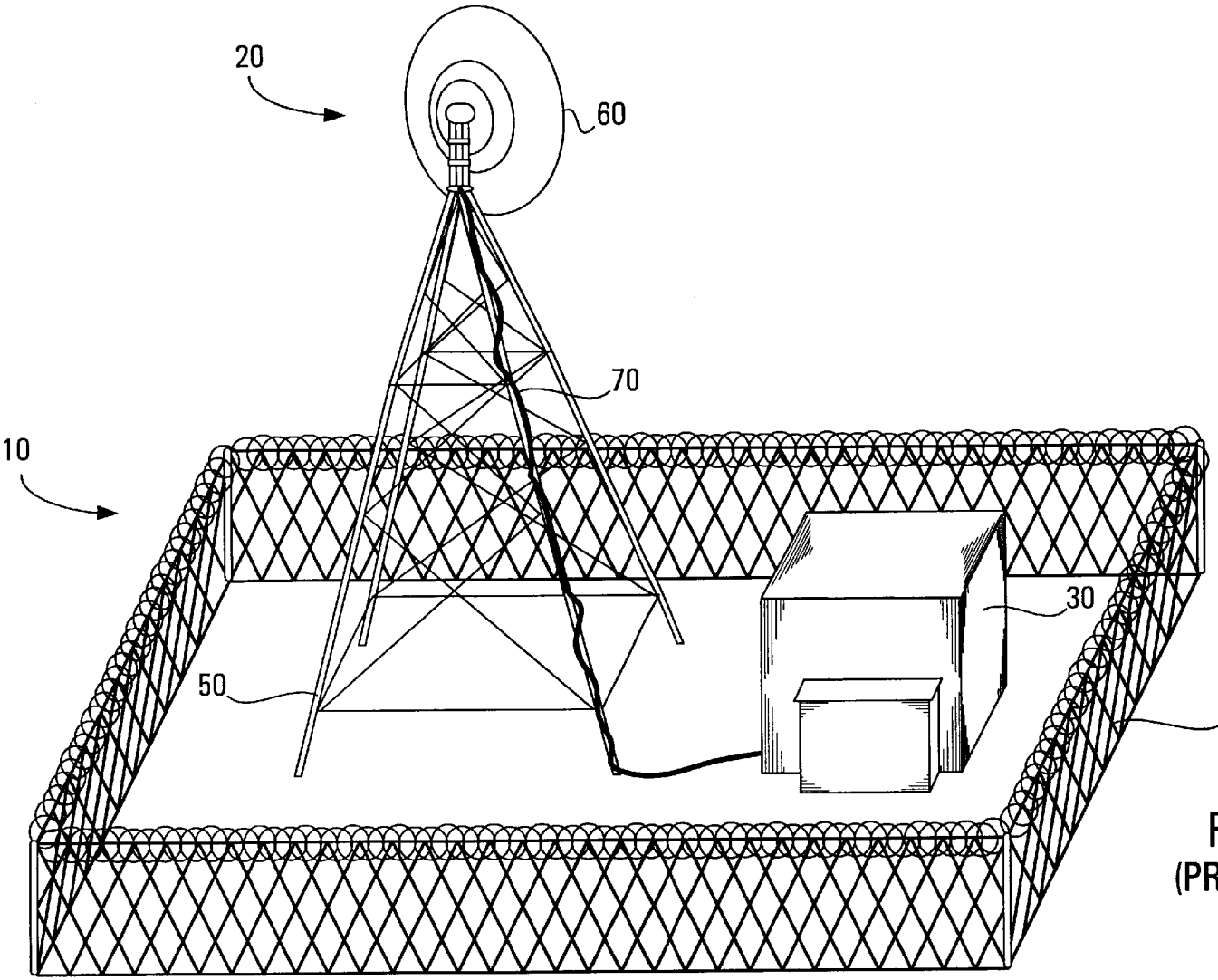
FIG. 1 (PRIOR ART)
FIG. 1 is a perspective view of a conventional radio communication site comprising an antenna structure, a base station structure and razor wire fence.

FIG. 1 shows a conventional radio communication site 10 which typically comprises an antenna structure 20, a base station structure 30 and razor wire fence 40 surrounding the antenna structure 20 and the base station structure 30. The antenna structure 20 typically comprises a lattice tower 50, an antenna 60, and transmission means 70. The base station structure 30 is typically an environmentally controlled hut housing communications equipment (not shown) and heating and cooling systems (not shown). The heating and cooling systems are used to maintain proper environmental conditions for the communications equipment. The transmission means 70 is connected to the antenna 60 and to the communications equipment. The transmission means 70 is typically coaxial cable.

The conventional radio communication site 10 is often costly to install and typically requires a substantial amount of real estate to be purchased or leased. The conventional radio communication site 10 is also typically costly and difficult to maintain especially when dealing with the maintenance of the antenna 60. Furthermore, a larger radio transceiver with a higher power output is typically required in the base station structure 30 to compensate for the transmission loss in the transmission means 70 especially when higher frequencies are being used.

Moreover, the conventional radio communication site 10 often meets with strong community resistance due to the scale and visual clutter of the conventional radio communication site 10.

Figure 2:
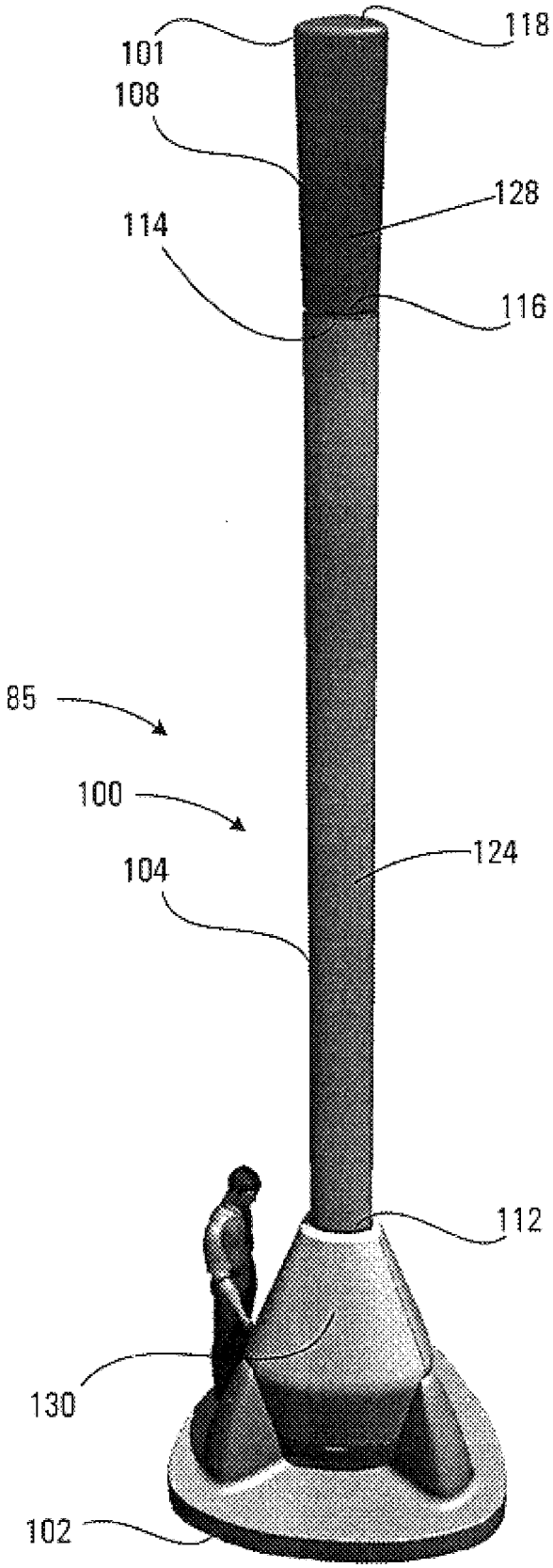
FIG. 2 is a perspective view of a radio communication site in accordance with a preferred embodiment of the present invention.
Figure 3:
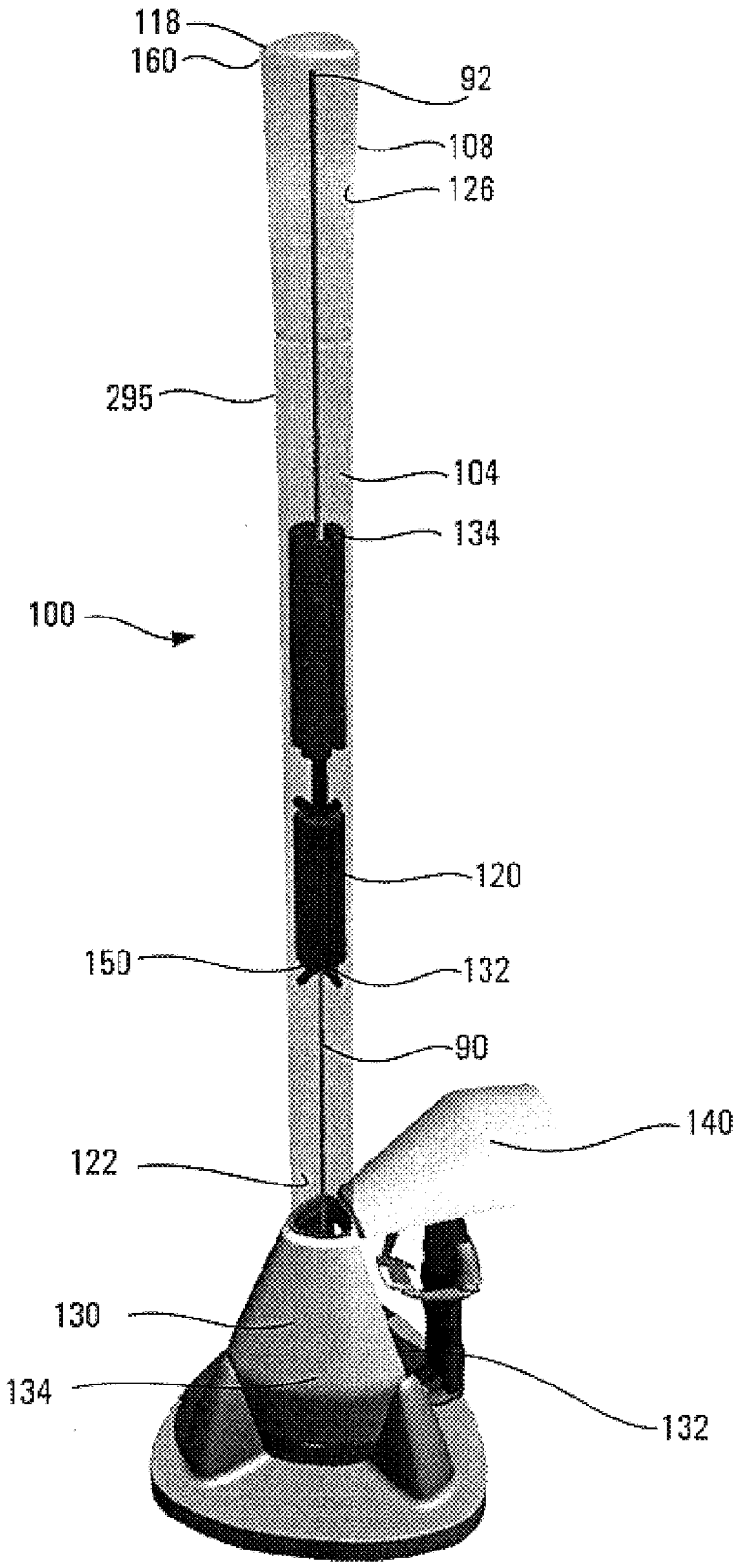
FIG. 3 is a perspective view of the radio communication site shown in FIG. 2 showing the hollow lower antenna mast and the hollow antenna top in cross section.
Figure 4:
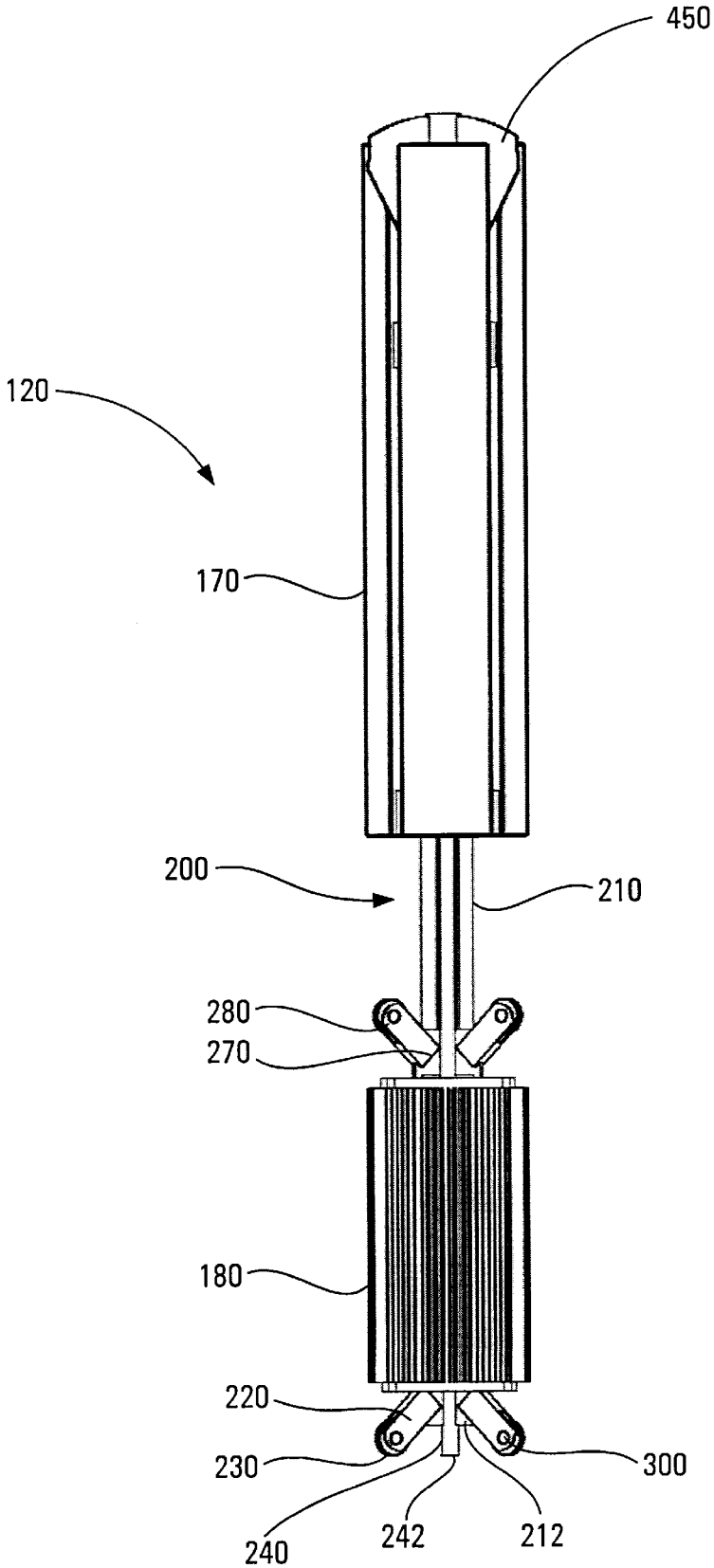
FIG. 4 is a front view of a movable module used in a preferred embodiment of the present invention.
Figure 5:
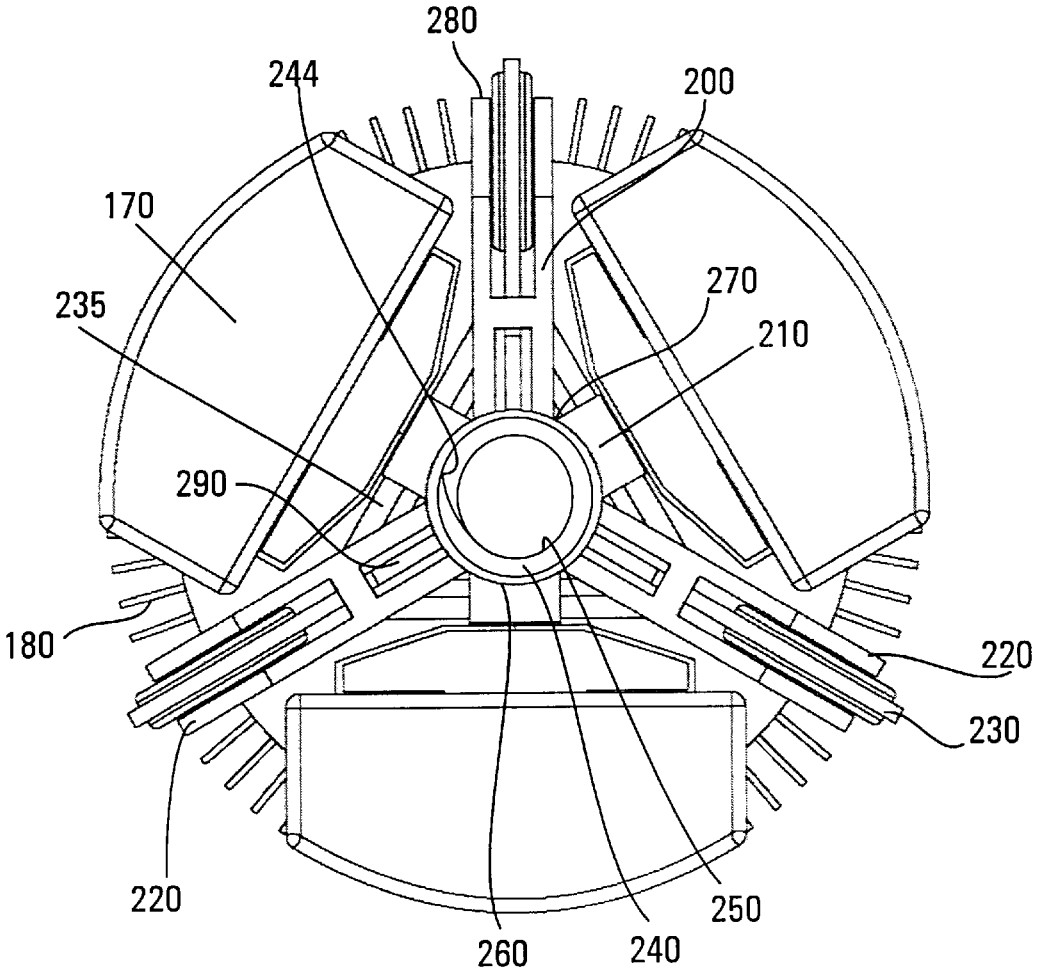
FIG. 5 is a top plain view of the movable module shown in FIG. 4.
Figure 6:
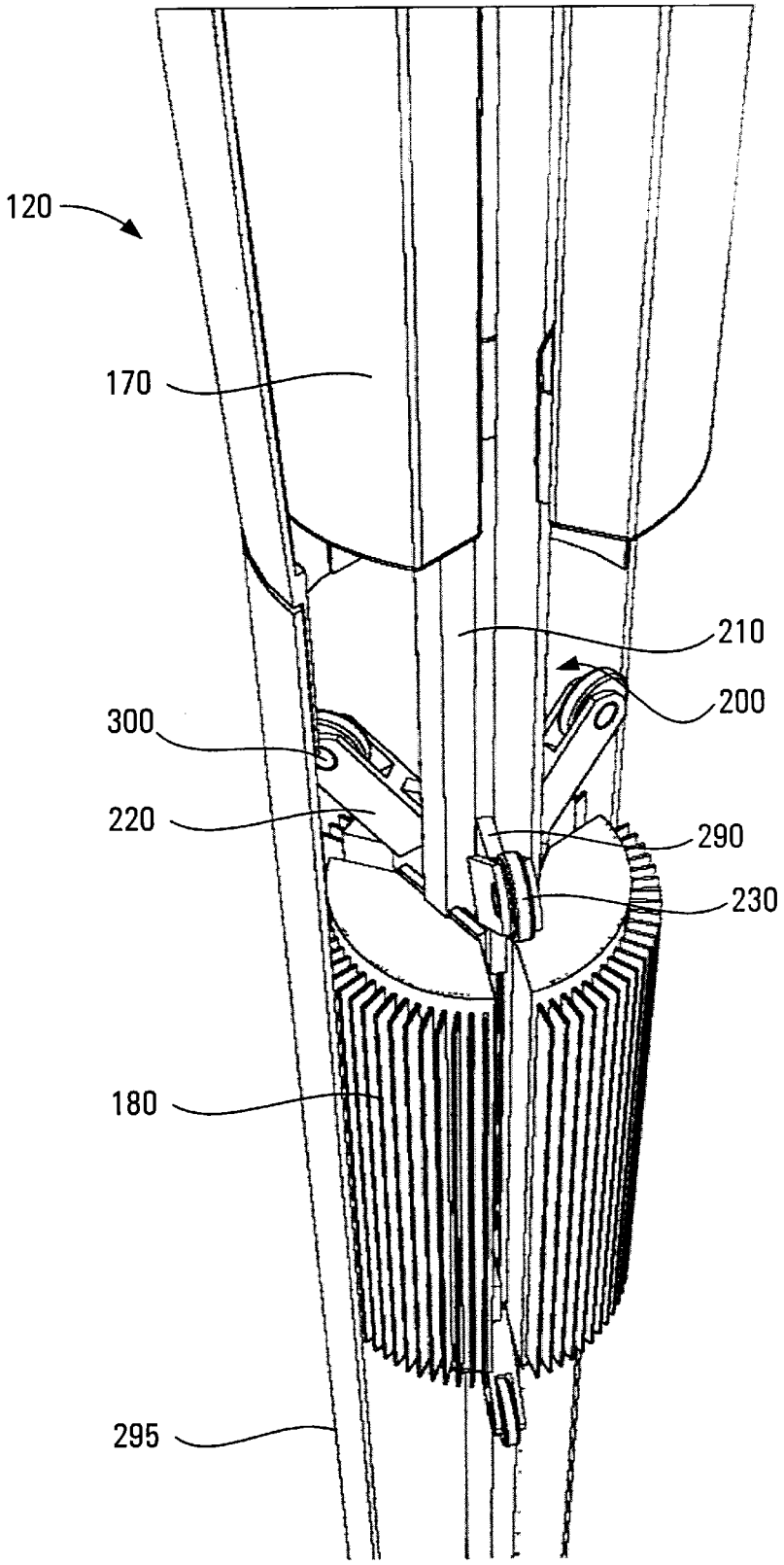
FIG. 6 is a perspective view of a portion of the movable module shown in FIGS. 4 and 5.
Figure 7:
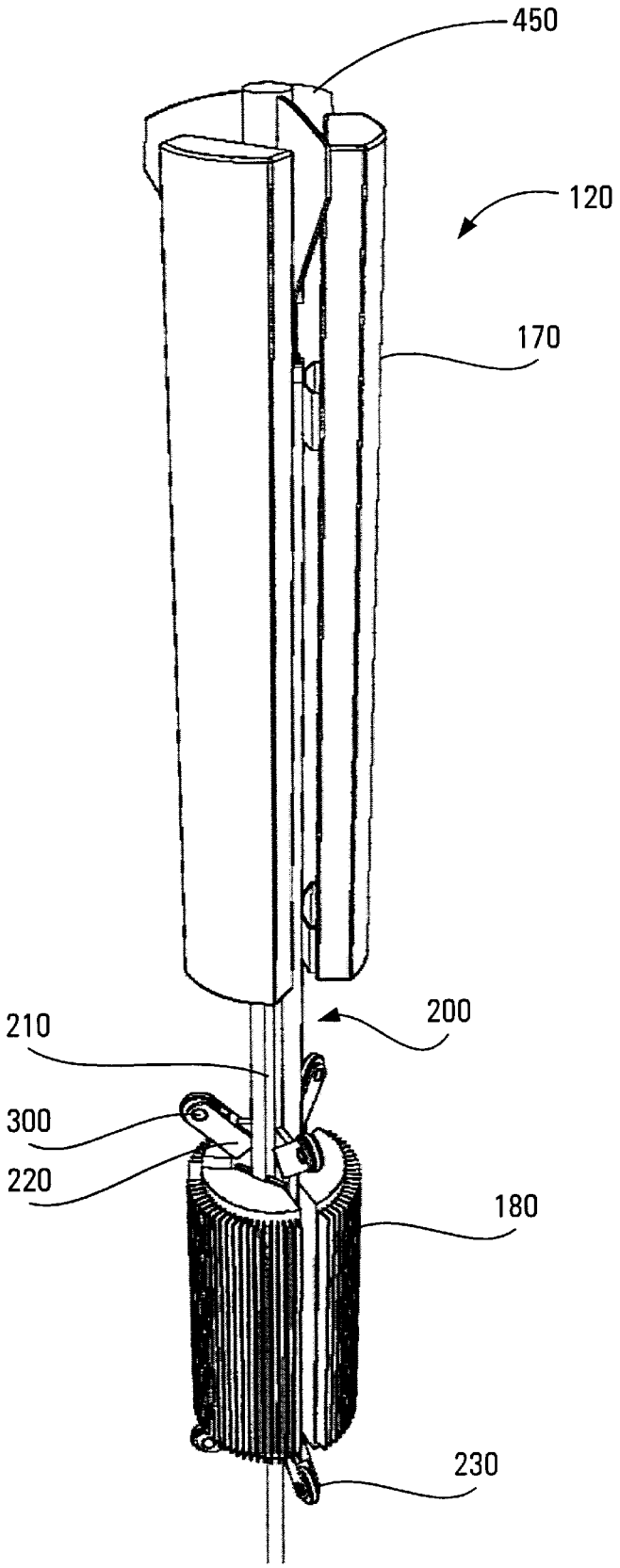
FIG. 7 is a perspective view of the movable module shown in FIGS. 4, 5 and 6.

In accordance with the preferred embodiment of the present invention, FIGS. 2 and 3 show an integrated radio communication site comprising an antenna structure 85 and communications equipment (not shown). The antenna structure 85 typically comprises a hollow mast 100, a movable module 120, lifting means and a first power and traffic transmission means (not shown).

The hollow antenna mast 100 has a top end 101 and a bottom end 102. The hollow antenna mast 100 is typically oriented vertically with the bottom end 102 attached to the ground or the top of a building. The movable module 120 is placed inside the hollow antenna mast 100. The lifting means permit the raising and lowering of the movable module 120 inside the hollow antenna mast 100. The lifting means are typically disposed inside the hollow antenna mast 100. The first power and traffic transmission means carry power from communications equipment (not shown) to the movable module 120 and carry traffic from the communications equipment to the movable module 120 and vice versa. (Discussed in more detail later).

The hollow mast 100 typically comprises a base 130, a hollow lower mast 104 and a hollow antenna top 108. The hollow lower mast 104 is open at a lower end 112 and at an upper end 114. The hollow antenna top 108 is open at a lower end 116 but closed at an upper end 118. The base 130 is typically firmly attached to the ground or the top of a building. The lower end 112 of the hollow lower mast 104 is attached to the base 130 using conventional methods such as welding or nuts and bolts. The lower end 116 of the hollow antenna top 108 is typically welded to the upper end 114 of the hollow lower mast 104.

The base 130 is generally hollow with an inside surface 132 and an outside surface 134. The base 130 generally has the shape of a truncated pyramid. The base 130 typically houses the lifting means and the communications equipment (not shown). (Alternatively, the communications equipment can be housed in a separate housing structure). The base 130 typically has one or more doors 140 providing access to a portion of the lifting means, the communications equipment and the movable module 120 for installation and maintenance purposes. The doors 140 are typically pivotally connected to the base 130 and typically have locks (not shown) to secure the doors 140.

The hollow lower mast 104 typically has the shape of a right circular hollow cylinder having an inside surface 122 and an outside surface 124. The hollow lower mast 104 is typically made from a carbon fibre composite, aluminum, or fiberglass and is typically 7 to 30 meters in length.

A hollow antenna top 108 has typically the shape of a right circular hollow cylinder having an inside surface 126 and an outside surface 128. Ideally, the hollow antenna top 108 is made from a material that does not significantly attenuate the passage of radio signals. Typically, the hollow antenna top 108 is made from fibre glass, polyurethane or similar material. The hollow antenna top 108 is typically one to two meters long.

The lifting means typically comprise an inner mast 90 and a rotor (not shown). The inner mast 90 has a top 92 and bottom (not shown). The bottom (not shown) of the inner mast 90 is attached to the rotor. (Discussed in more detail later). The inner mast 90 and rotor are placed inside of the hollow mast 100 with the base attached to the base 130. The top 92 of the inner mast 90 is typically secured to the upper end 118 of the hollow antenna mast 108 (discussed in more detail later).

The movable module 120 has a bottom 132 and top 134. The movable module is movable along the inner mast 90 (discussed in more detail later). In particular, the top 134 of the movable module 120 is movable between a lower position 150 and an upper position 160.

Referring to FIGS. 4, 5, 6 and 7, the movable module 120 typically comprises three antennas 170, three RF modules 180, three RF transmission means (not shown) and three second power and traffic transmission means (not shown) and a carriage 200.

The carriage 200 has a lower end and upper end. The carriage 200 typically comprises three conduits 210, six struts 220, six plates 290, six guide wheels 230, three connector assemblies 235, three antenna mounts (not shown) and a threaded carrier 240. The threaded carrier 240 has typically the shape of a right circular cylinder having an inside surface 250 and an outside surface 260. The threaded carrier 240 has a lower end 242 and an upper end 244.

The antennas 170 and the RF modules 180 are fastened to the carriage 200 with the antennas 170 typically above the RF modules 180 (discussed in more detail later). The antennas 170 and the RF modules 180 are typically equally spaced around the circumference of the threaded carrier 240.

The antennas 170 are used to receive and transmit radio signals. The selection of the type of antenna depends on the application and the frequency or frequencies being used. The RF modules 180 modulate radio signals and demodulate radio signals.

Each conduit 210 is fastened to the outside surface 260 of the threaded carrier 240 along the longitudinal axis of the threaded carrier 240. The conduits 210 are typically equally spaced around the circumference of the threaded carrier 240. Each conduit 210 is hollow and has typically a rectangular parallelepiped shape. Each conduit has a lower end 212 and an upper end 214. Each antenna 170 is connected to the carriage 200 near the upper end 214 of each conduit 210 (explained in more detail later).

Three plates 290 are attached to the outside surface 260 of the threaded carrier 240 near the lower end 242 of the threaded carrier 240 and three plates 290 are attached to the outside surface 260 of the threaded carrier 240 near the upper end 244 of the threaded carrier 240. The plates 210 are typically equally spaced around the circumference of the threaded carrier 240 with each plate 290 typically placed in between two conduits 210.

Each strut 220 has an inner end 270, an outer end 280 and biasing means (not shown). The inner end 270 of each strut 220 is pivotally connected to each plate 290. Each guide wheel 230 is connected near the outer end 280 of each strut 220 typically by means of an axle 300. Typically, the biasing means comprises a spring attached to the respective strut 220 and the respective plate 290.

There are typically three ridges 295 on the inside 122 of the hollow lower mast 104. Typically, the ridges 295 are equally spaced along the circumference of the hollow antenna mast 104, are parallel to the longitudinal axis of the hollow lower mast 104 and run from the lower end 112 to the upper end 114. The biasing means forces a strut 220 outwardly towards the ridges 295 on the hollow lower mast 104 such that the guide wheels 230 are received by the ridges 295. The engagement of the guide wheels 230 with the ridges 295 prevent the rotational movement of the movable module 120 around the longitudinal axis of the threaded carrier 240 and make it easier for the movable module 120 to move up or down the inner mast 90.

The inner mast 90 has a thread that mates with a complementary thread on the inside surface 250 of the threaded carrier 240 such that when the inner mast 90 is turned in a direction by the rotor, the movable module moves upward towards the upper position 160, and when the inner mast 90 is turned in an opposite direction by the rotor, the movable module moves downward towards the lower position 150.

Figure 8:
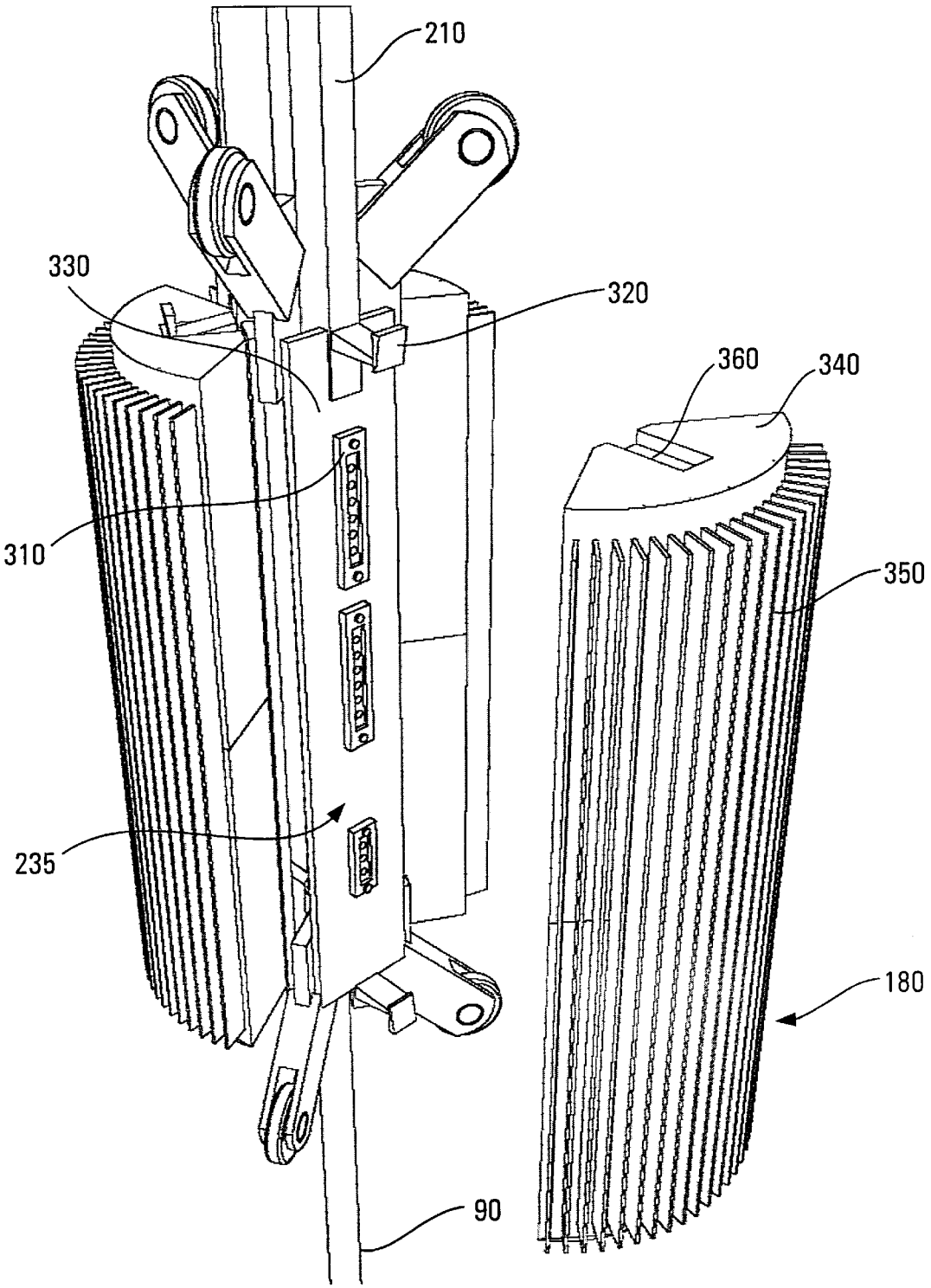
FIG. 8 is an exploded perspective view of a portion of the movable module shown in FIGS. 4, 5, 6 and 7 in which one of the RF modules is shown apart from the rest of the movable module.
Figure 9:
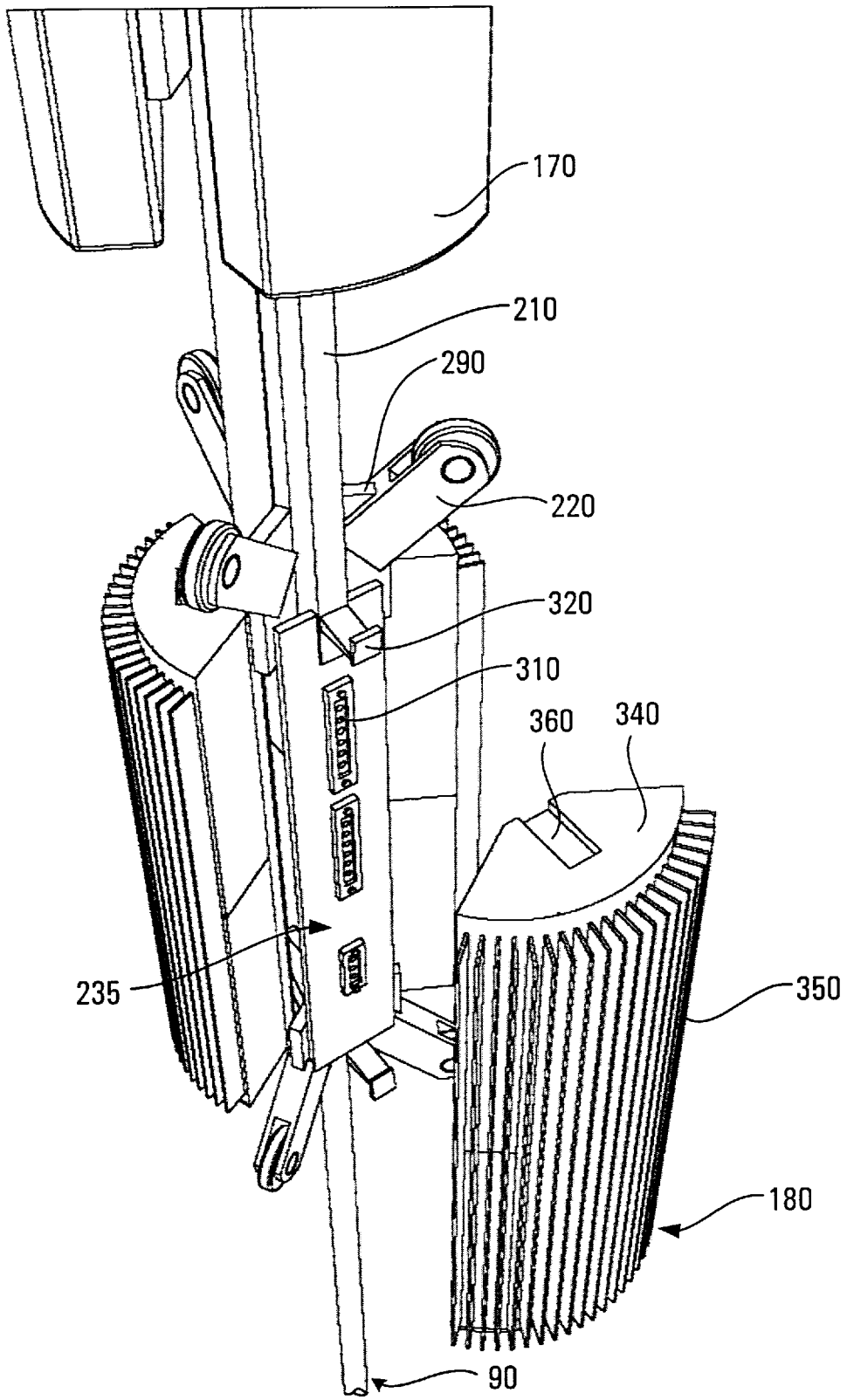
FIG. 9 is a perspective view of a portion of a movable module shown in FIG. 8.
Figure 10:
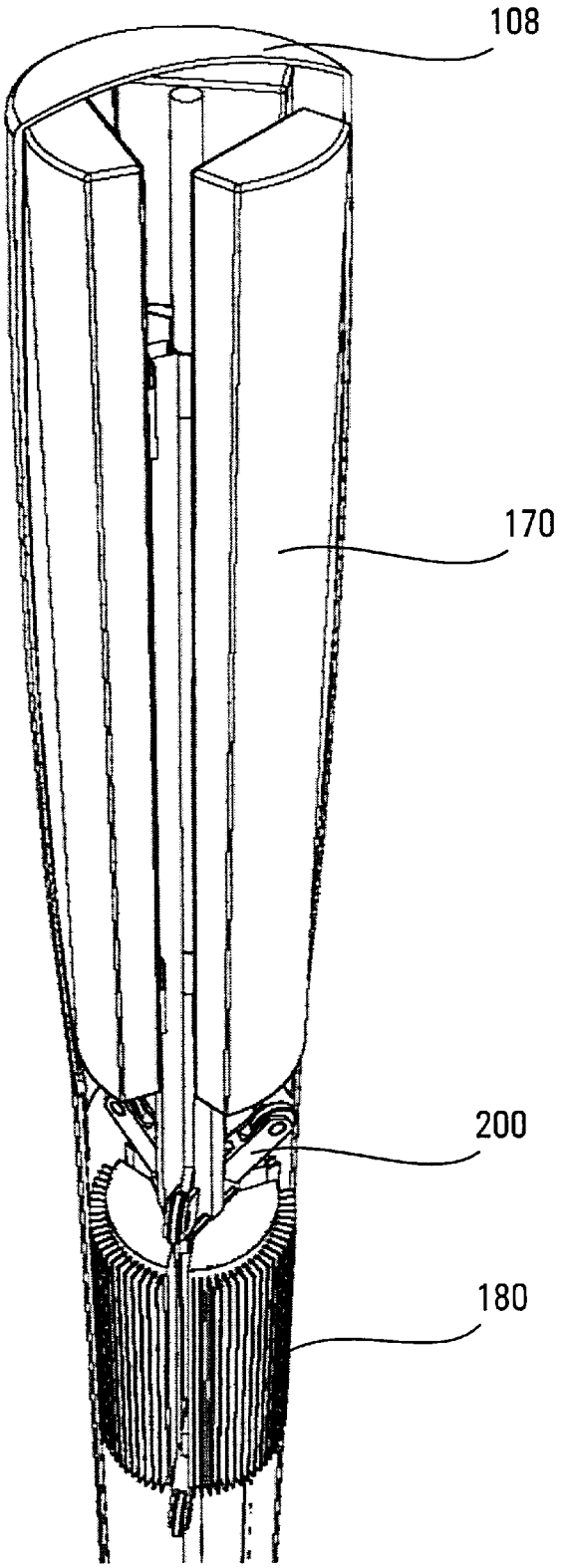
FIG. 10 is a perspective view of the movable module shown inside the hollow antenna mast in accordance with the preferred embodiment of the present invention.
Figure 11:
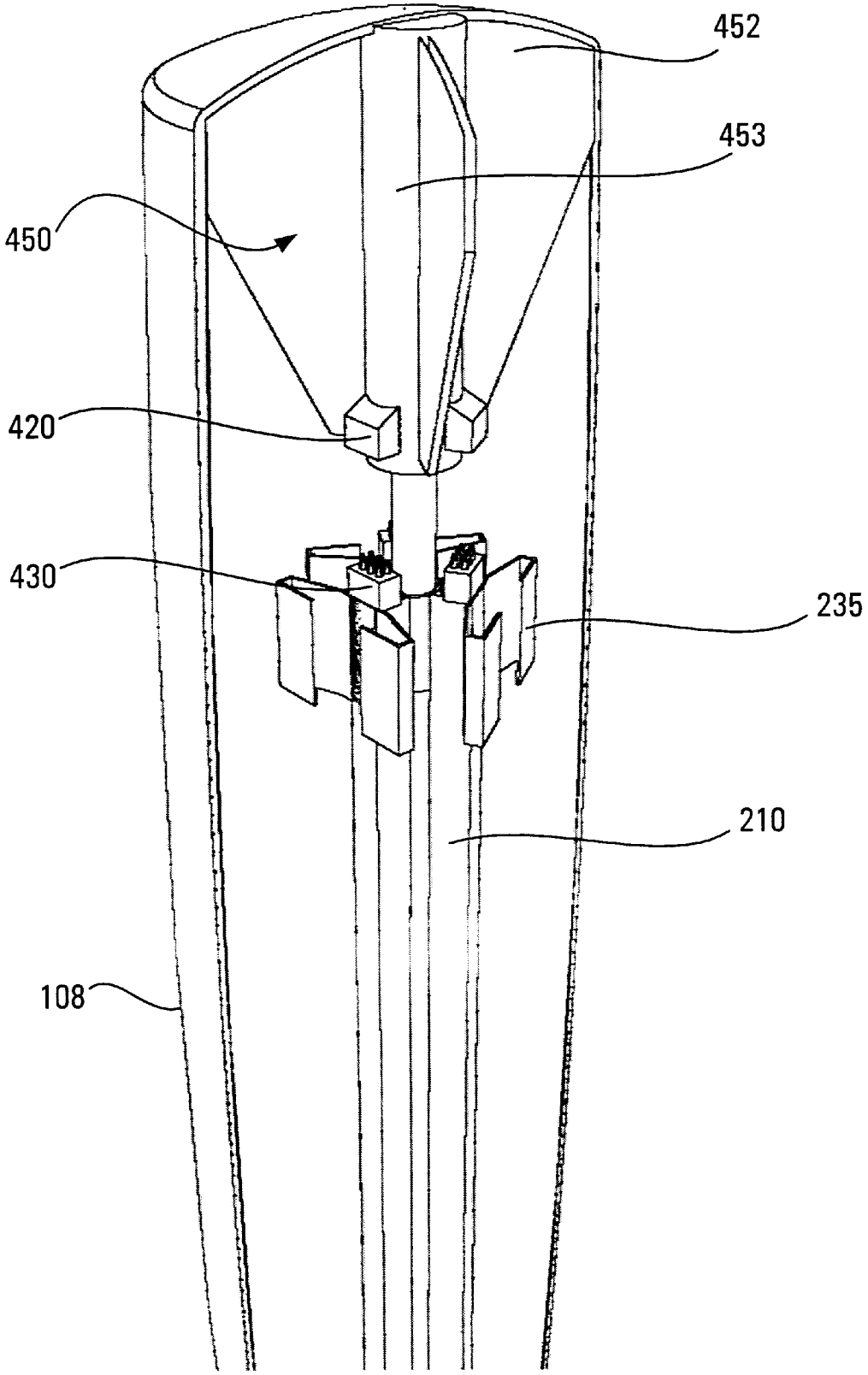
FIG. 11 is a perspective view of the hollow antenna top in cross-section showing the inner mast, the antenna, the antenna mounts and portions of the first power and traffic transmission means and portions of the second power and traffic transmission means.
Figure 12:
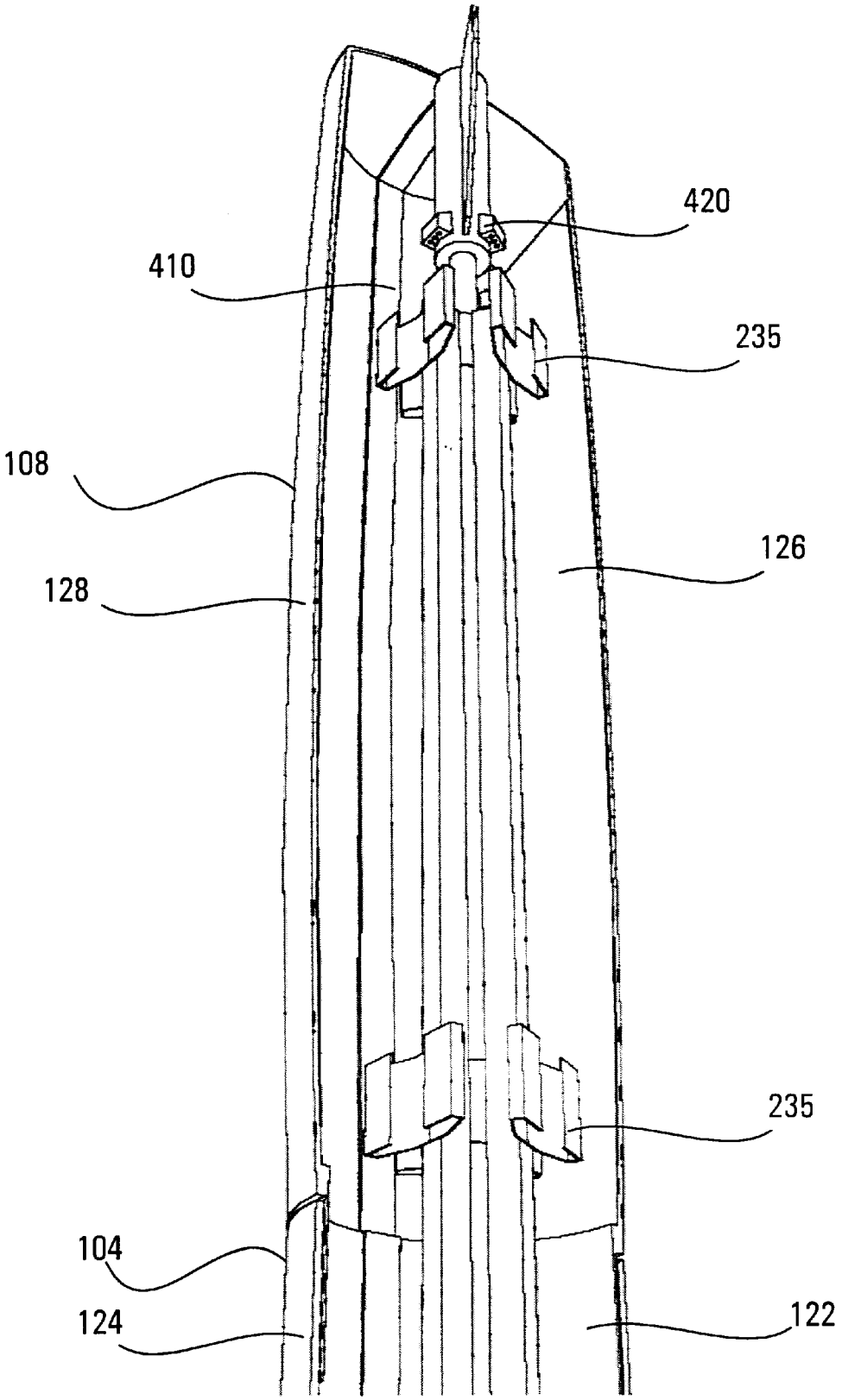
FIG. 12 is a perspective view of the hollow antenna top shown in FIG. 11.
Figure 13:
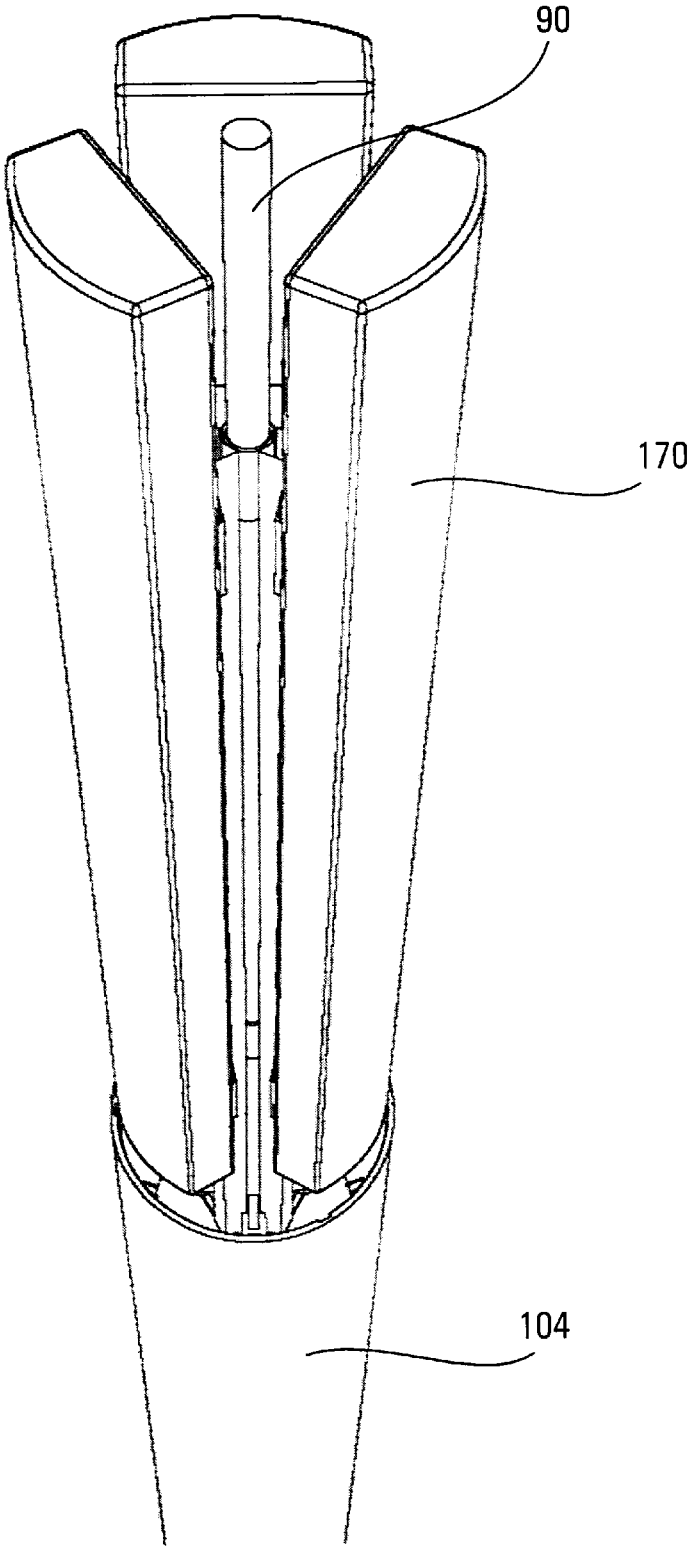
FIG. 13 is a perspective view of a portion of the movable module shown in the upper position without the hollow antenna top.
Figure 14:
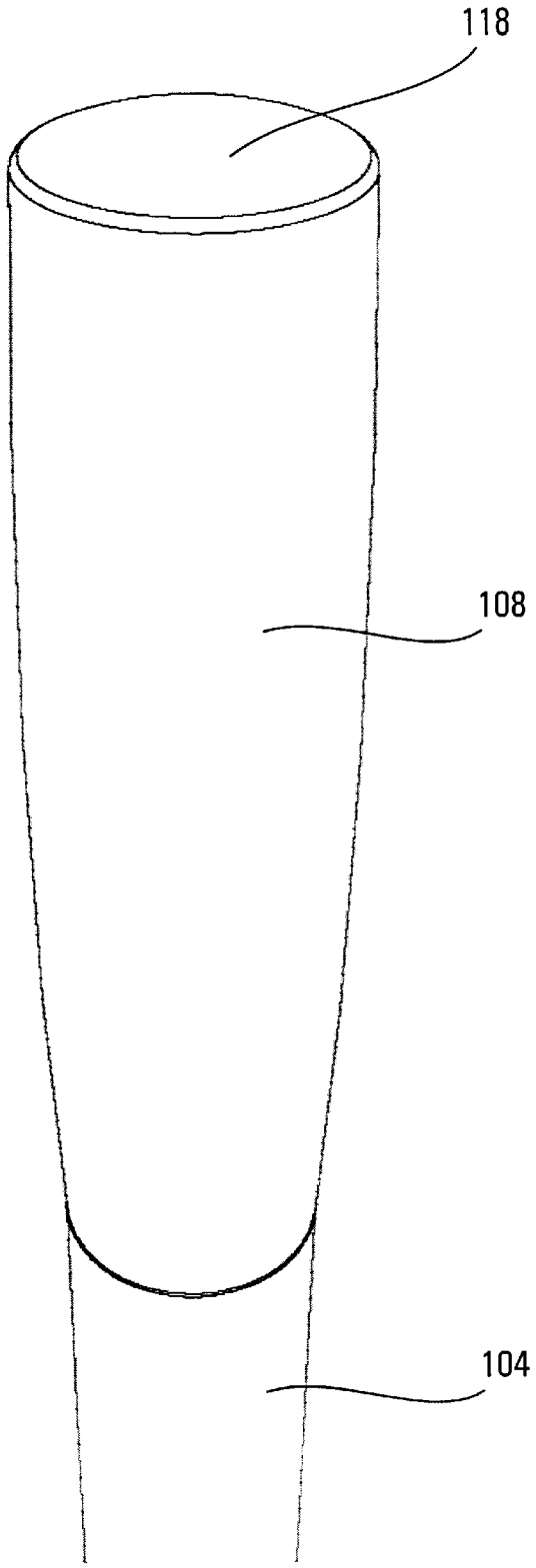
FIG. 14 is a perspective view of the hollow antenna top and a portion of the hollow lower mast.

Each connector assembly 235 is attached to a conduit 210 near the lower end 212 of the conduit 210. Referring to FIGS. 8, 9 and 10, each connector assembly 235 typically comprises a plurality of connectors 310, two retainer clips 320 and a plate 330. The connectors 310 are mounted on the plate 330. The two retainer clips 320 are also attached to the plate 330. The plate 330 is attached to the conduit 210.

Each RF module 180 typically comprises a radio transceiver used to modulate and demodulate radio signals, a plurality of complementary connectors (not shown), a housing 340, and a plurality of heat sink fins 350. The housing 340 houses the radio transceiver. The complementary connectors are mounted on the housing 340. The heat sink fins 350 are attached to the housing 340 and allow for the dissipation of heat generated by the radio transceiver. The housing 340 has two grooves 360.

Each RF module 180 mates with the respective connector assembly 235. In particular, the complementary connectors on each RF module 180 mate with the respective connectors 310. In addition, the two retainer clips 320 mate with the two grooves 360 and hold each RF module 180 in place.

The connectors 310 and the complementary connectors are typically electrical connectors such as male and female DB25 and DB9 connectors.

Each RF transmission means are connected to the respective antenna 170, pass through a hole in the respective conduit 210, run along the inside of the respective conduit 210 and are finally typically connected to one of the respective connectors 310. The RF transmission means carry the radio signals from the RF modules 180 to the antennas 170 and vice versa. The RF transmission means typically is a coaxial cable. The selection of the coaxial cable depends on the frequency of the radio signals; being used and power output of the radio transceiver. For example, low loss cable, such as hardline, is typically used for VHF and UHF frequencies. Such frequencies are typically used for services such as cellular radio telephone. Since the length of each RF transmission means is typically very short, the transmission losses in each RF transmission means is negligible compared to the transmission losses in the transmission means 70 used in the conventional radio communication site 10 shown in FIG. 1.

Referring to FIGS. 11, 12, 13 and 14, the antenna mounts 235 are attached near the upper end 244 of the threaded carrier 240. Complementary antenna mounts (not shown) on the antennas 170 engage with the antenna mounts 235 to hold the antennas 170 on the carriage 200. The hollow antenna top 108 typically further comprises a support bracket 450. The support bracket 450 is attached on the inside surface 126 of the hollow antenna top 108 at the upper end 118 of the hollow antenna top 108 to provide better support. The support bracket 450 typically comprises three fins 452 and a bore 453. The bore 453 mates with the top 92 of the inner mast 90.

The first power and traffic transmission means typically comprise three connectors 420 and a cable 410 with two ends. The connectors 420 are typically mounted on the support bracket 450. The cable 410 is connected to the connectors 420 and to the communication equipment (typically housed. inside the base 130. As mentioned earlier, the communications equipment could be housed in a separate housing structure. In such a case, the cable 410 would be routed through a hole in the base 130). The cable 410 is routed between the connectors 420 and the communications equipment in a manner that does not significantly interfere with the movement of the movable module 120. In one embodiment, the cable 410 is attached at a plurality of locations along the inside surface 122 of a hollow lower mast 104 and the inside surface 126 of the hollow antenna top 108. The locations chosen for each cable are always between the same two ridges 295 in order to ensure that the cable 410 does not significantly interfere with the movement of the movable module 120.

The cable 410 typically comprises seven sub-cables—a power cable, three in traffic cables and three out traffic cables. The power cable is connected to each connector 420. Each in traffic cable is connected to the respective connector 420. Similarly, each out traffic cable is connected to the respective connector 420.

Alternatively, three main cables could be used in place of cable 410. Each main cable would comprise a power cable, an in traffic cable and an out traffic cable. Each main cable is connected to the communications equipment and to the respective connector 420.

The second power and traffic transmission means typically comprise three complementary connectors 430 and three short cables (not shown). The complementary connectors 430 are mounted on the conduits 210 respectively. The three short cables are placed inside the conduits 210 respectively. The three short cables are connected to the complementary connectors 430 respectively and to the connectors 310 respectively. Each short cable typically comprises three sub-cables—a short power cable, a short in traffic cable and a short out traffic cable.

Alternatively, the first power and traffic transmission means comprise three connectors 420 and three fibre optic cables, each fibre optic cable is connected to the communications equipment housed inside the base 130. The other end of each fibre optic cable is connected to a respective connector 420. The fibre optic cables are routed between the connectors 420 and the communications equipment in a manner that does not significantly interfere with the movement of the movable module 120. Furthermore, each short cable used in the second power and traffic transmission means is a fibre optic cable.

When the movable module 120 is in the upper position 160, the connectors 420 mate with the complementary connectors 430. As mentioned earlier, the connectors 310 mate with the complementary connectors (not shown) on each RF module 180. When the connectors 420 are mated with the complementary connectors 430 arid the connectors 310 are mated with the complementary connectors on each RF module 180, power and traffic is carried from the communications equipment to the RF modules 180 and traffic is carried from the RF modules 180 to the communications equipment via the first power and traffic transmission means and the second power and traffic transmission means. In particular, the power cables and the short power cables carry power to the RF modules 180. The in traffic cables arid the short in traffic cables carry traffic to the RF modules 180 from the communications equipment. The out traffic cables arid the short out traffic cables carry traffic from the RF modules 180 to the communications equipment.

The traffic typically consists of voice and data traffic. The cable 410 and the short cables typically use standard copper cable.

Referring to FIGS. 15, 16, 17, 18, 19 and 20, the base 130 typically comprises platform 500, sub-base 510, tube 520, three support fins 530, three support brackets 540, three backplane sub-walls 550 and three doors 140.

Typically, the sub-base 510 has a generally triangular shape with three apexes 512. The platform 500 is typically poured concrete poured into a hole in the ground with a top 502 having a shape similar to that of the sub-base 510. Each support brackets 540 is typically attached to the sub-base 510 at the respective apex 512. Each support bracket 540 is also attached to the top 502 of the platform 500.

Figure 19:
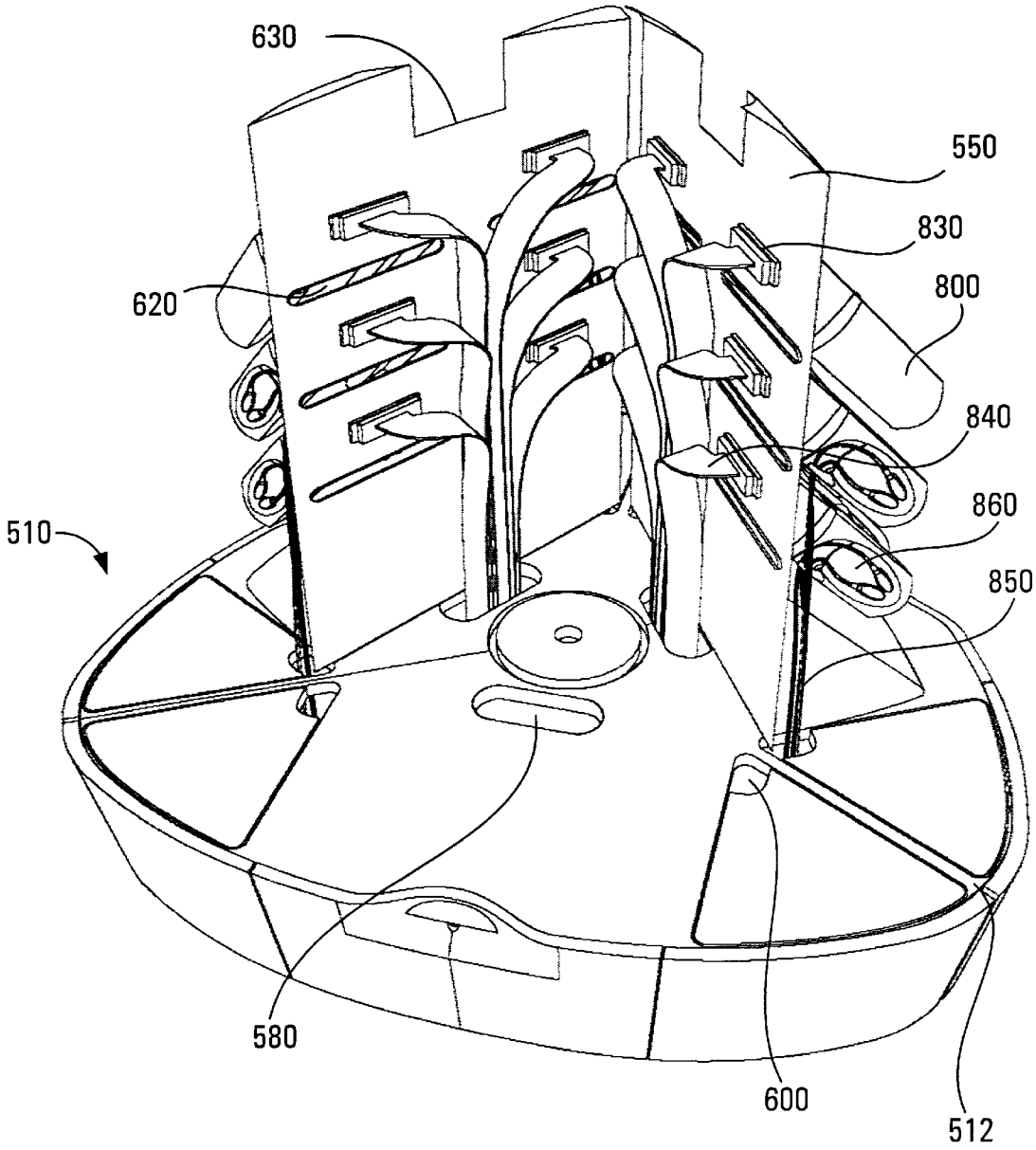
FIG. 19 is a perspective view of the sub-base and two backplane sub-walls showing some of the communications equipment.

Referring in particular to FIG. 19, the backplane sub-walls 550 are attached to the sub-base 510. Each backplane sub-wall 550 typically consists of connector mounting holes (not shown) and convection vents 620 and grooves 630.

Figure 15:
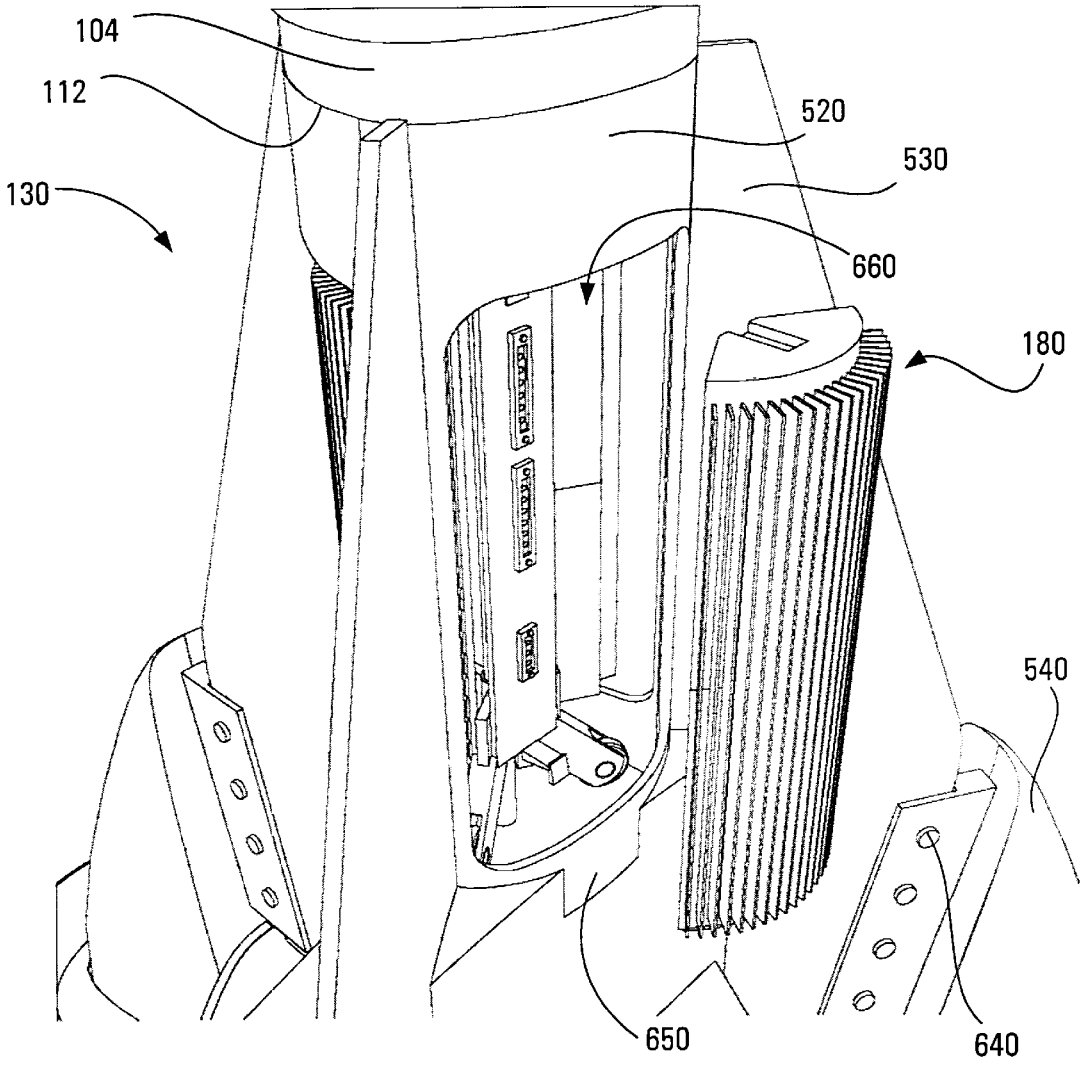
FIG. 15 is a partial exploded perspective view of a portion of the base and a portion of the movable module with one of the RF modules shown apart from the rest of the movable module.
Figure 16:
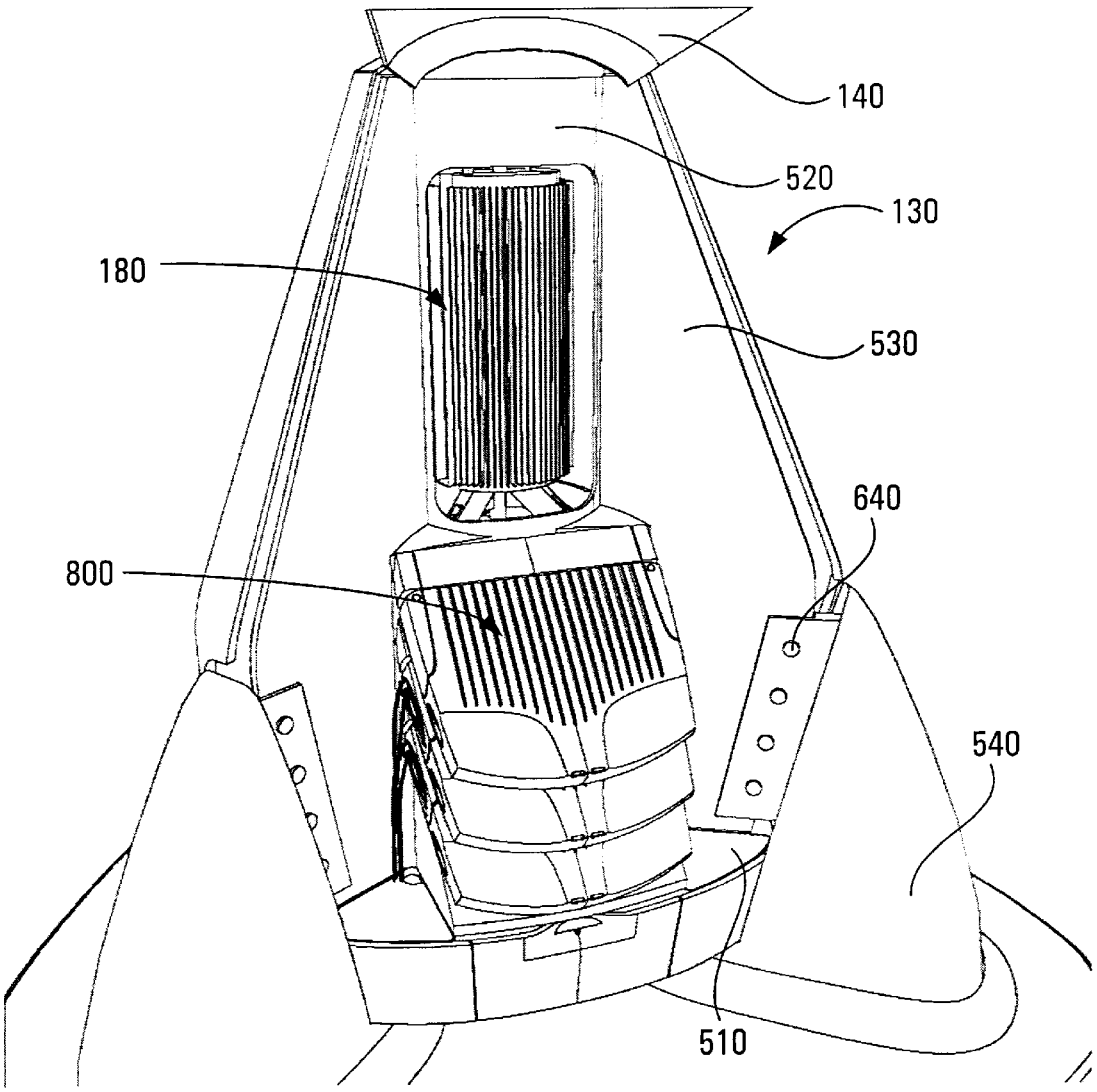
FIG. 16 is a perspective view of a portion of the base, a portion of the communication equipment and a portion of the movable module.
Figure 17:
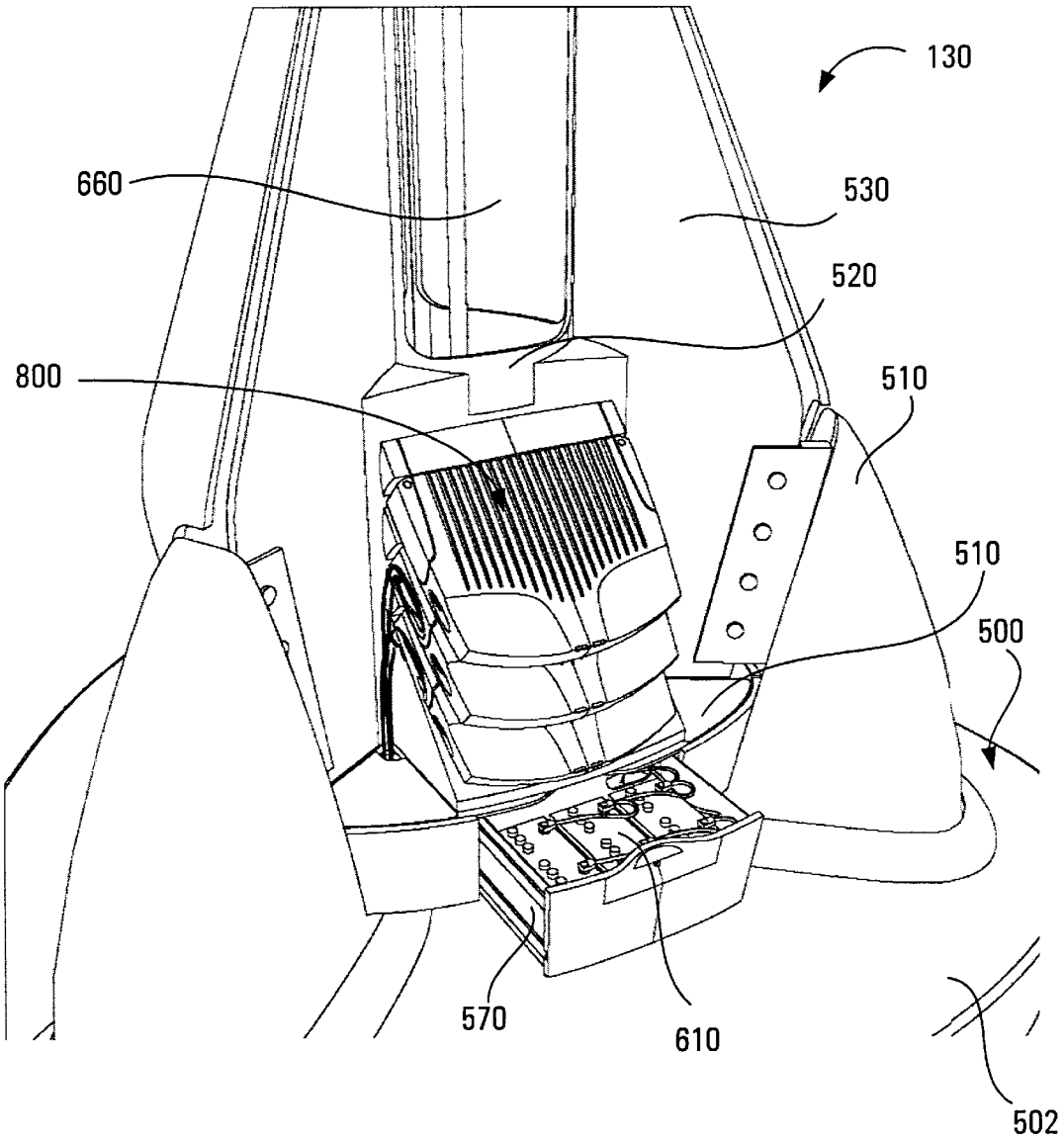
FIG. 17 is a perspective view of a portion of the base and portion of the communications equipment shown in FIG. 16.
Figure 20:
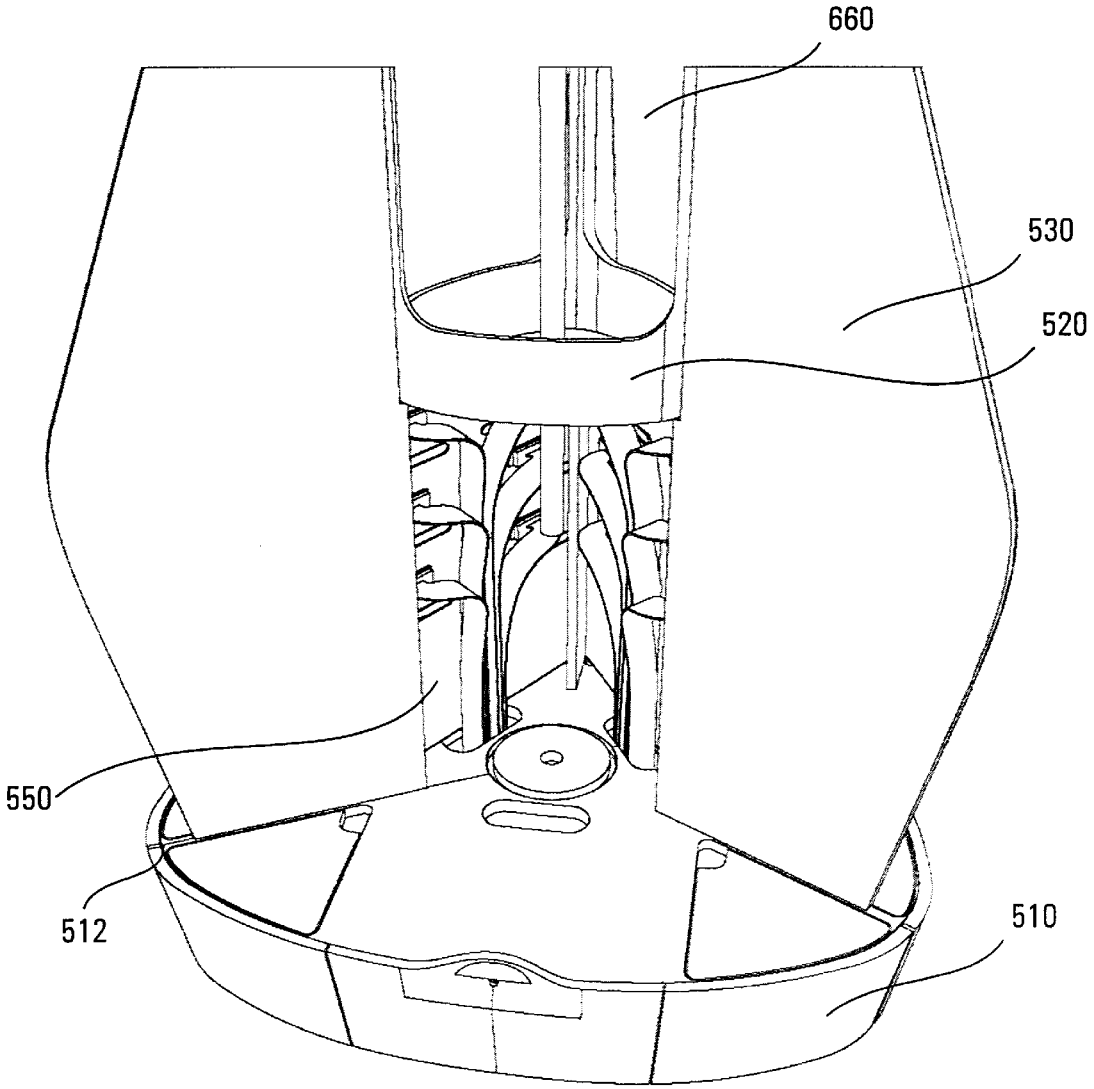
FIG. 20 is a perspective view of the sub-base, the support fins, the tube, two of the backplane sub-walls and some of the communication equipment.

Referring to FIGS. 15, 16 and 20, the support fins 530 sit on the sub-base 510 and are attached to the support brackets 540 typically using nuts and bolts 640. The tube 520 is hollow and has a right circular cylindrical shape. The tube 520 also typically has three lips 650 and three module extraction holes 660. The tube 520 sits on top of the black backplane sub-walls 550 with the lips 650 engaging the grooves 630. The support fins 530 engage the tube 520. (Typically, the support fins 530 are welded to the tube 520). The lower end 112 of the hollow mast 104 is typically welded to the tube 520. The module extraction holes permit access to the movable module when the movable module is in the lower position 150.

There are typically three doors 140 pivotally connected to the tube 520. In addition, the doors 140 typically have locks (not shown) to secure the doors 140.

Figure 18:
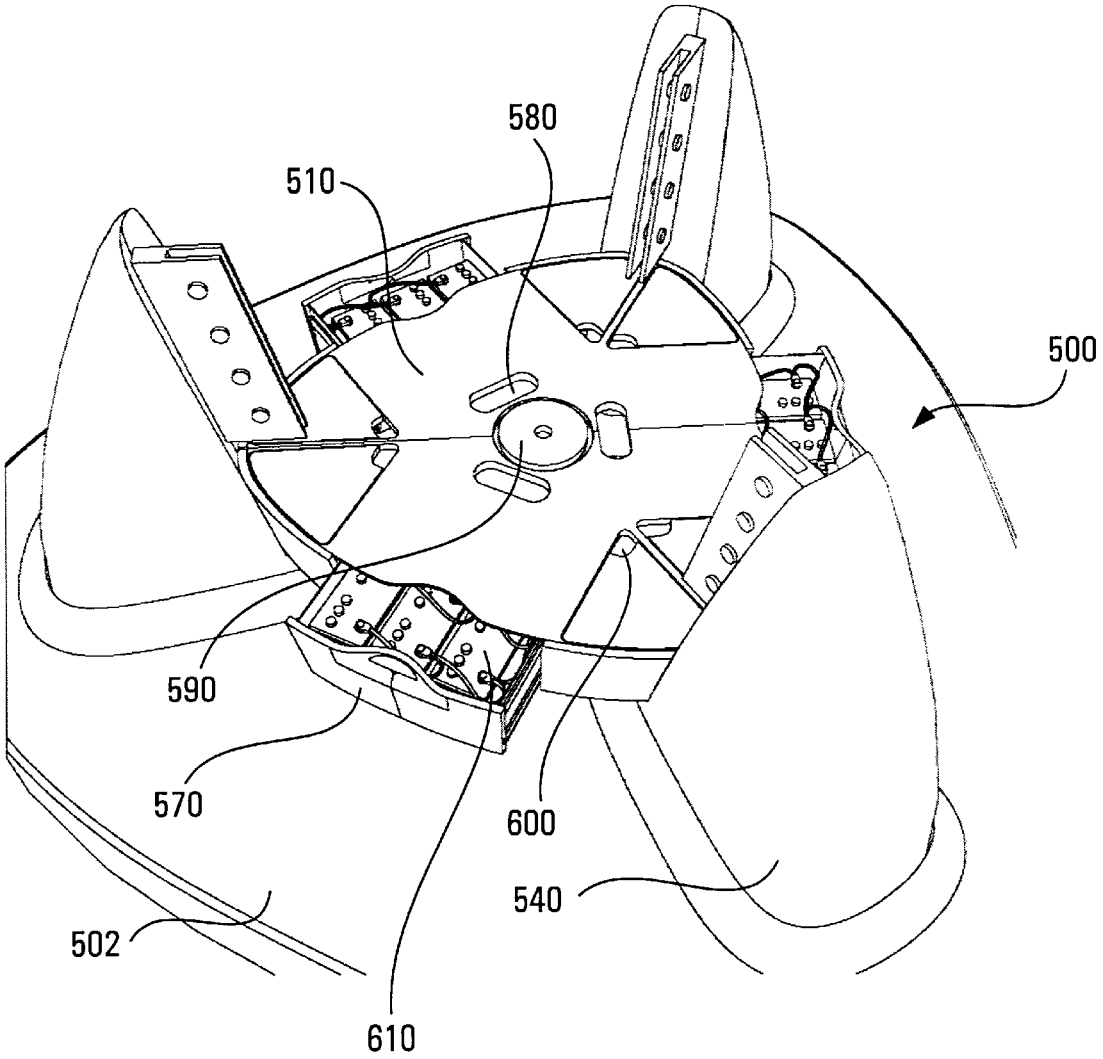
FIG. 18 is a perspective view of the platform, the sub-base and the support fins.

Referring in particular to FIG. 18, sub-base 510 typically has three battery compartments 570, three ribbon cable holes 580, one rotor cable access panel 590 and six cable holes 600. The battery compartments 570 house batteries 610 which are typically used to provide backup power to the communication equipment and RF modules 180.

The main power is typically provided by a power utility company using alternating current (AC). The main power is typically carried by power cables underground. The power cables typically pass through a hole (not shown) in the platform 500 and another hole (not shown) in the sub-base 510.

Figure 21:
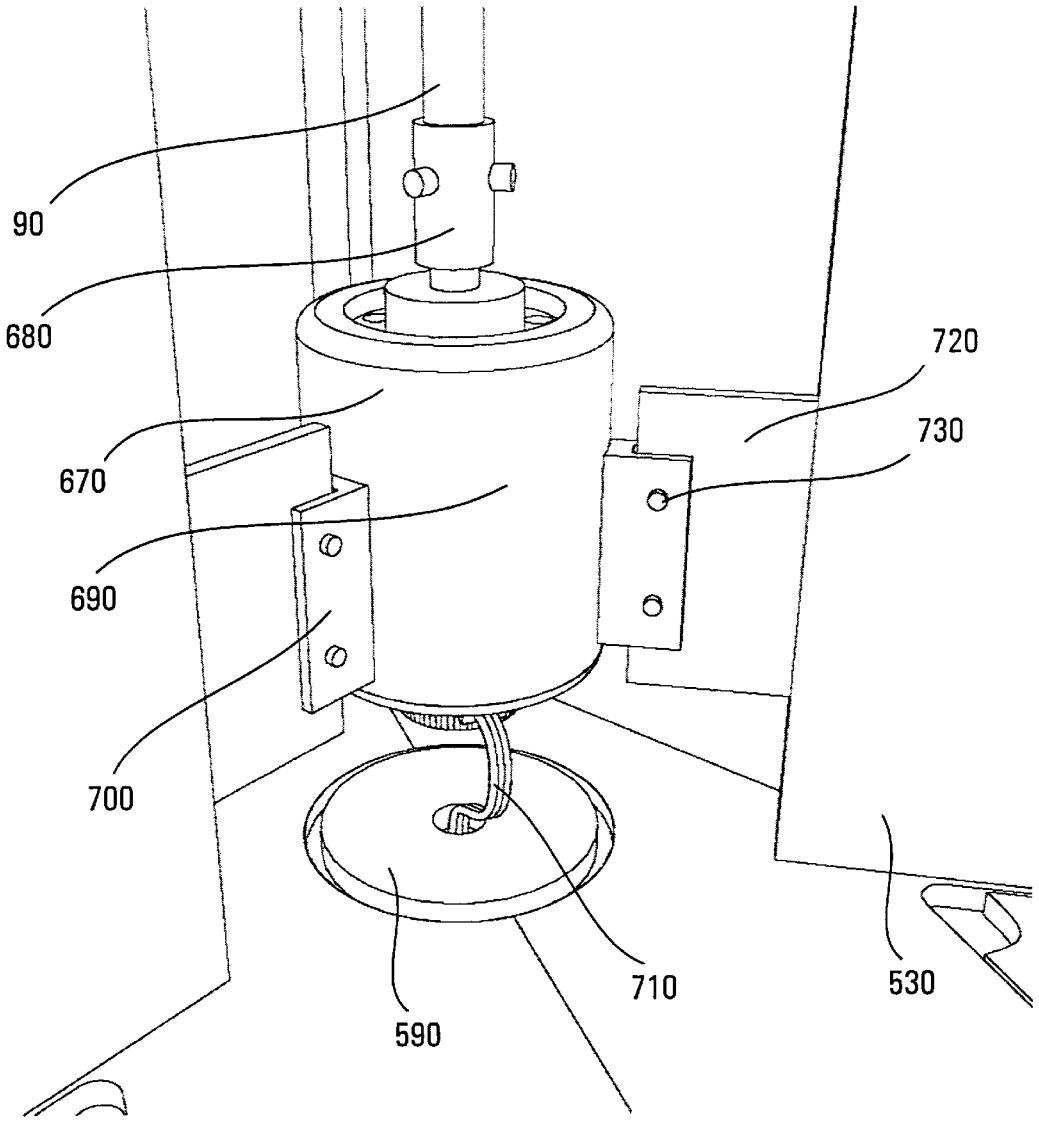
FIG. 21 is a perspective view of the rotor attached to two support ends and showing a portion of the sub-base.
Figure 22:
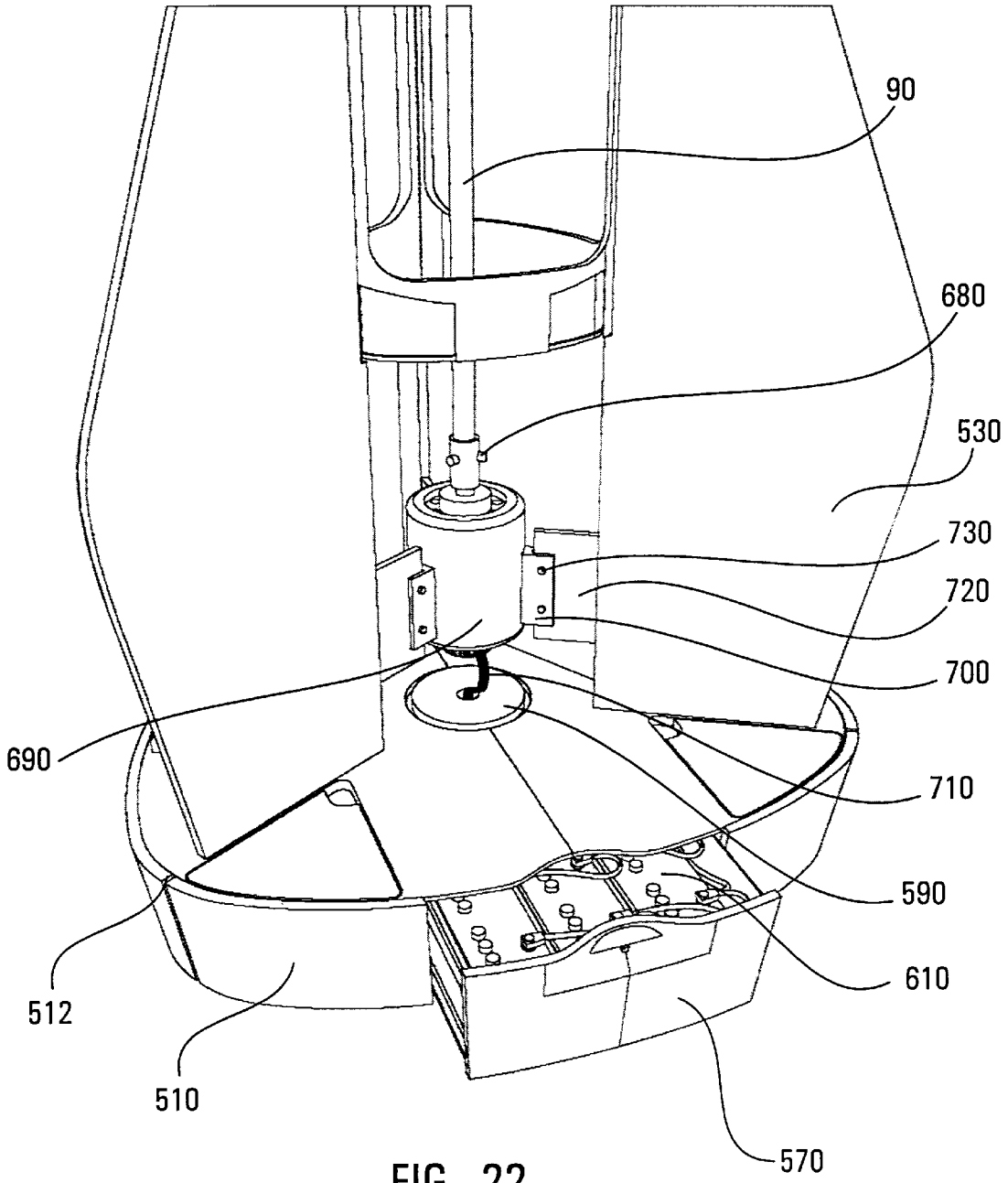
FIG. 22 is a perspective view of the sub-base, the support fins, the rotor and the tube.
Figure 23:
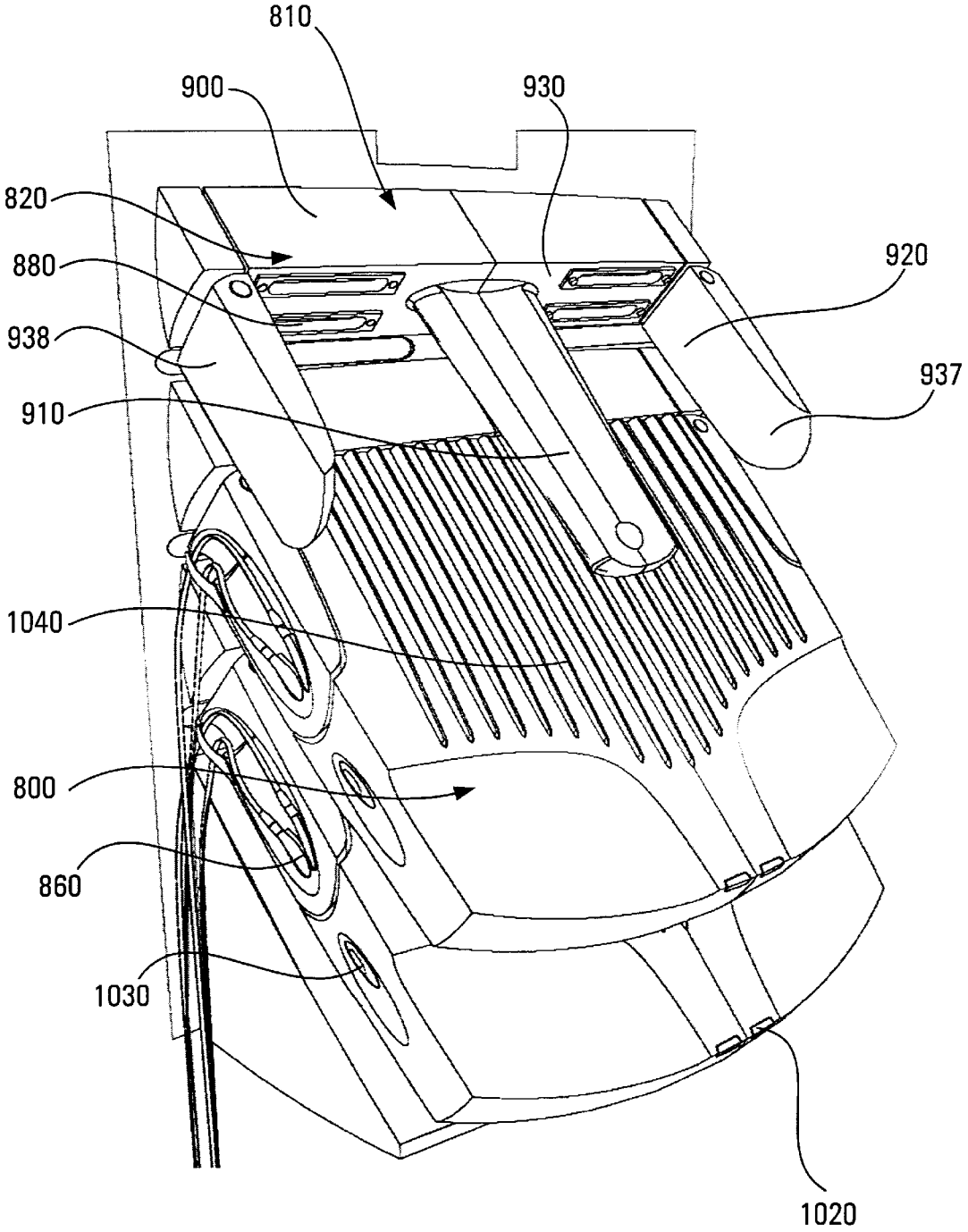
FIG. 23 is a perspective view of three module assemblies mounted on a backplane sub-wall and two modules.
Figure 24:
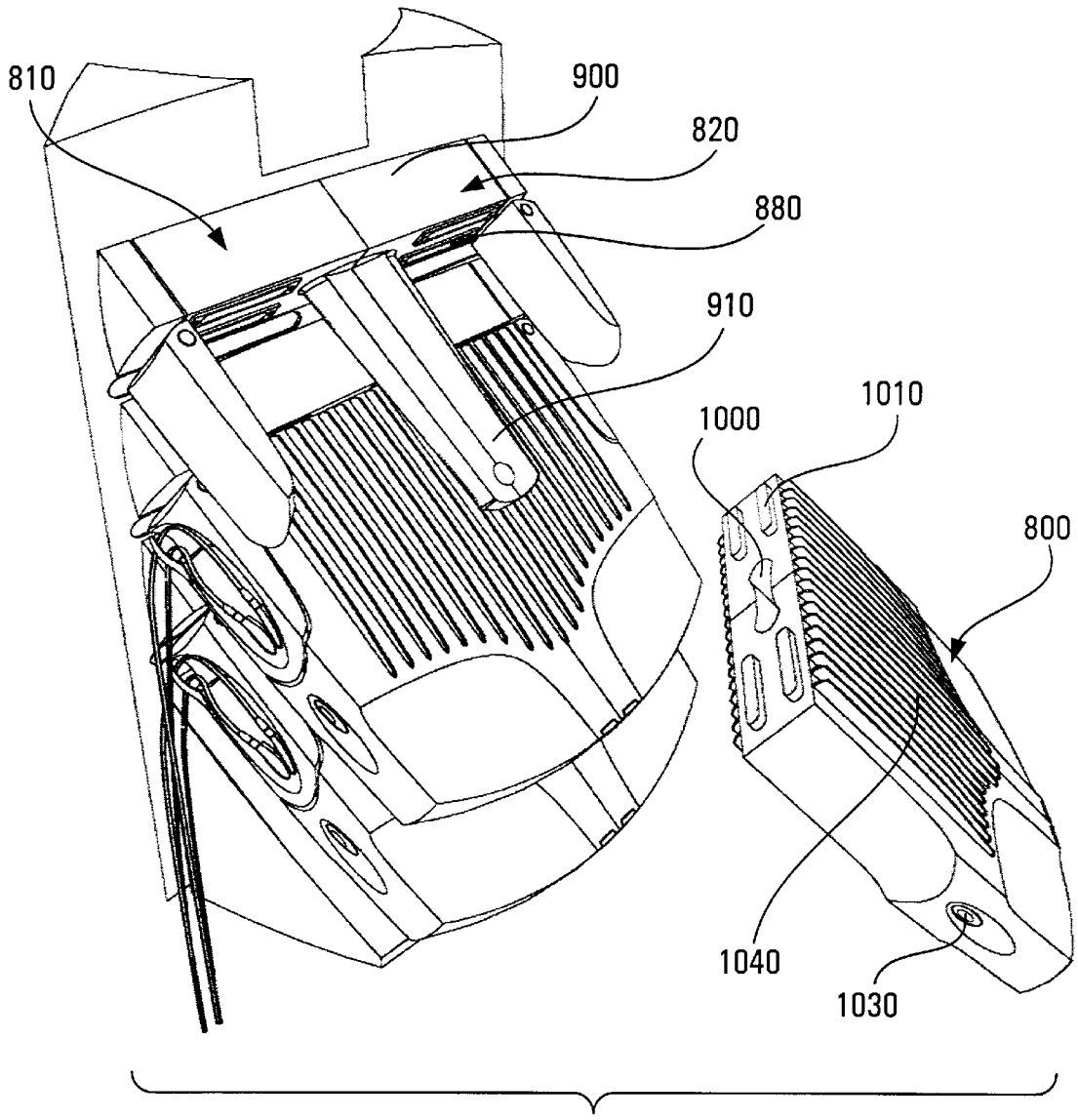
FIG. 24 is a perspective view of the three module assemblies and the two modules shown in FIG. 23 as well as a perspective view of another module shown apart from the module assembly.
Figure 25:
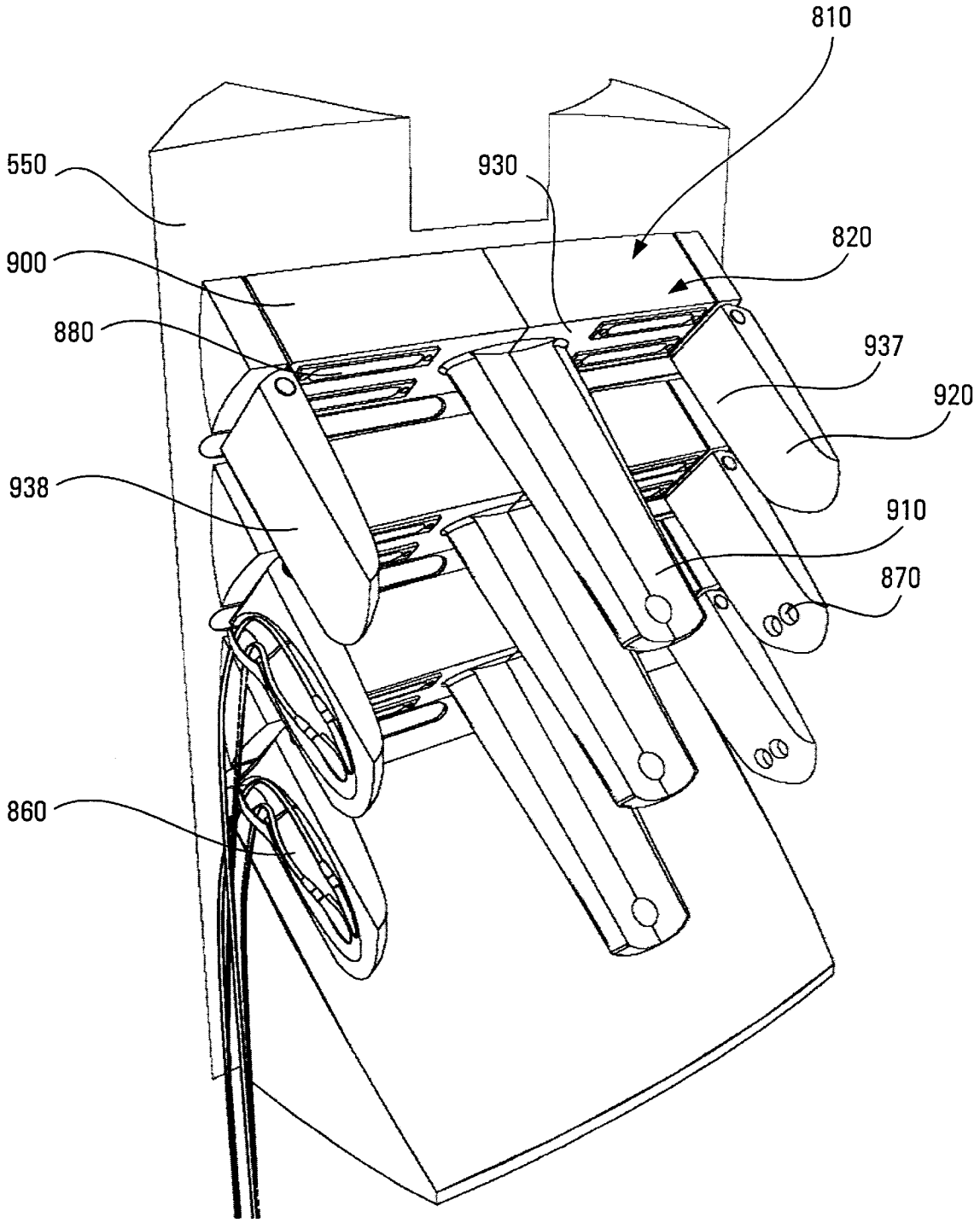
FIG. 25 is a perspective view of three module assemblies mounted on a backplane sub-wall.
Figure 26:
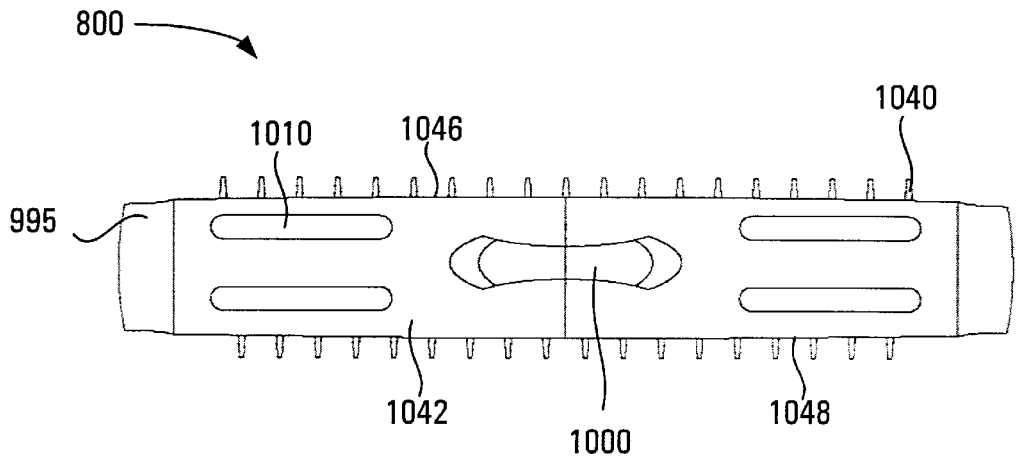
FIG. 26 is a back view of a module.
Figure 27:
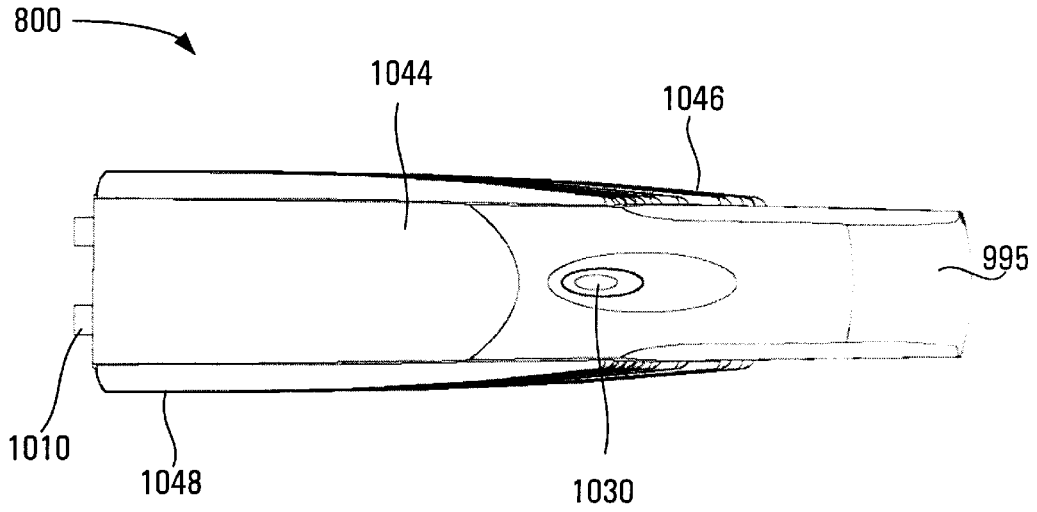
FIG. 27 is a side view of a module.
Figure 28:
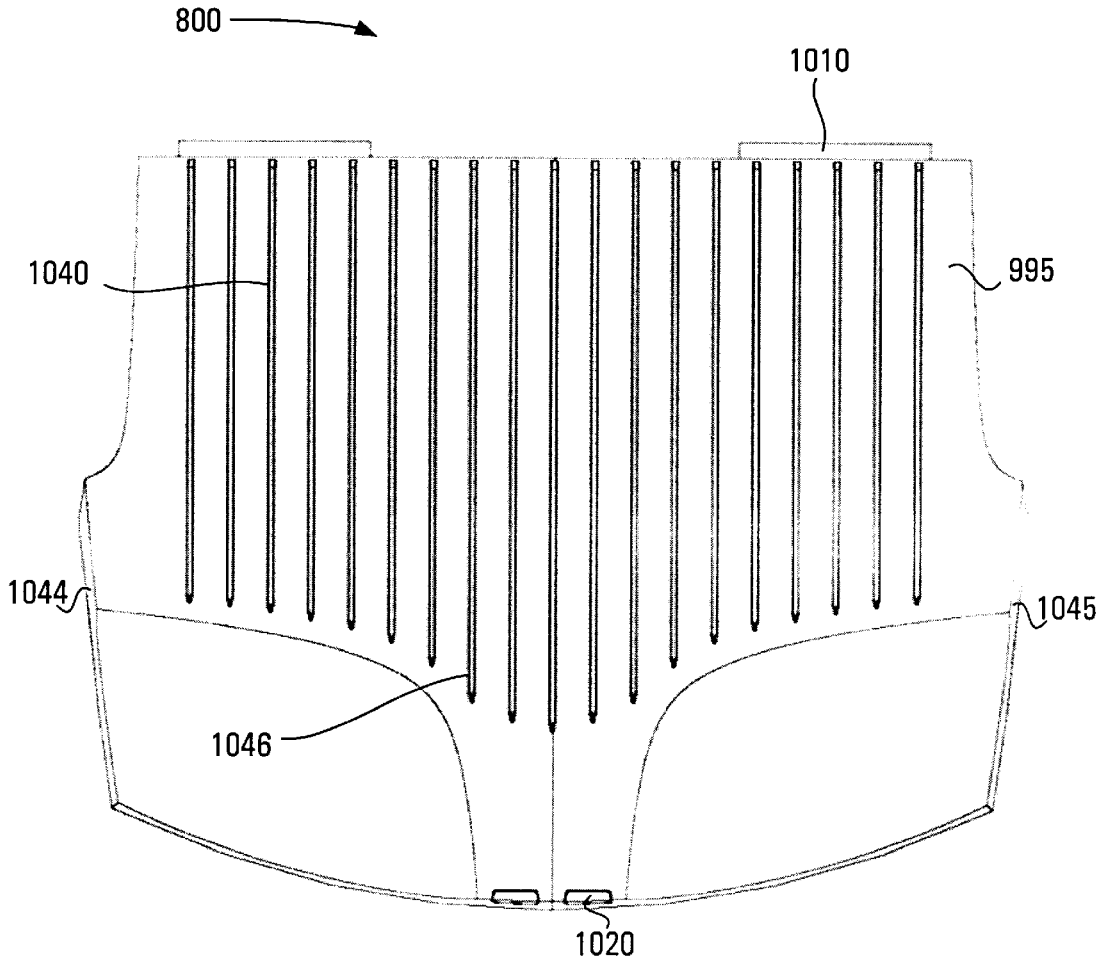
FIG. 28 is a top view of a module.
Figure 29:
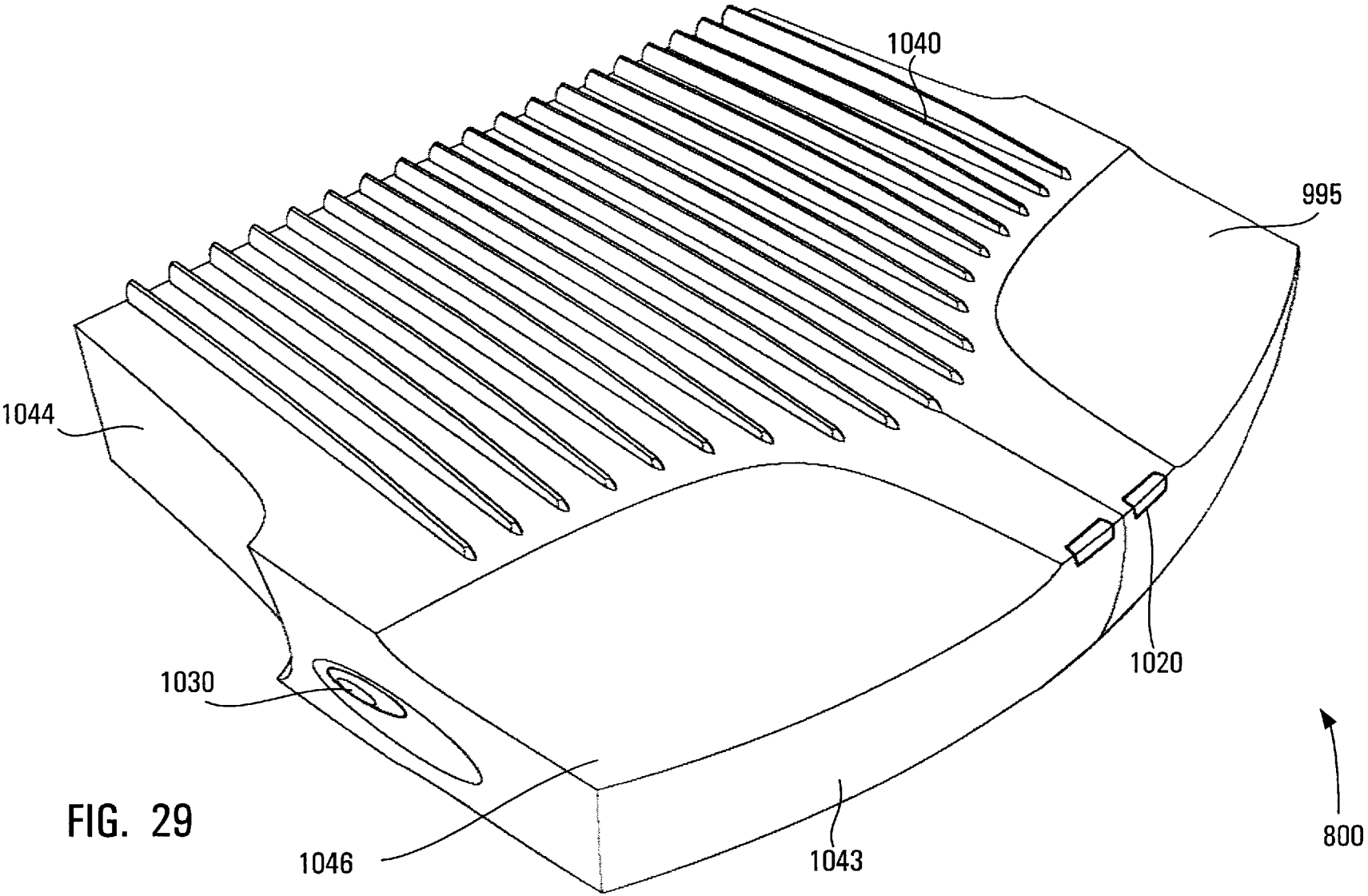
FIG. 29 is a perspective view of a module.

Referring to FIGS. 21 and 22, the rotor 670 typically comprises a couple 680, a motor 690, three motor brackets 700 and power and control cables 710. The support fins 530 typically further comprise three plates 720. The motor brackets 700 are attached to the motor 690 typically by welding. The motor brackets 700 are attached to the plates 720 by nuts and bolts 730. The motor 690 is coupled to the inner mast 90 via the couple 680. The power and control cables 710 are connected to the motor 690 and pass through a hole in the rotor cable access panel 590. The power and control cables carry power and control signals to the motor 690. The power and control cables are connected to a switch (not shown) and to power. The switch can stop the motor 690, activate the motor 690 to turn in the direction causing the movable module 120 to move off the inner mast 90 and activate the motor 690 to turn in the opposite direction causing the movable module 120 to move down the inner mast 90.

Referring to FIGS. 19, 20, 23, 24 and 25, the communications equipment typically consists of a plurality of modules 800 and a plurality of module assemblies 810. The module assemblies 810 are typically used to provide power to the modules 800 and to interconnect the modules 800. The module assemblies 810 may also be used to carry data and traffic away from the communication site (e.g. to a public switch telephone network (PSTN)) and vice versa.

Each module assembly 810 typically comprises a connector block 820, a plurality of black plane connectors 830, a plurality of ribbon cables 840, a plurality of I/O cables 850, a plurality of ganged connectors 860, a plurality of ganged connector I/O ports 870, a plurality of module connectors 880 and a plurality of short cables (not shown). Each connector block 820 typically comprises a base 900, a module support stem 910 and ganged connector grips 920. The base 900 and the ganged connector grips are typically hollow. The base 900 is typically wedged shaped with two plane surfaces meeting at a small acute angle. Opposite the acute angle is a rectangular surface 930 attached to the two plane surfaces. The rectangular surface 930 has two ends and a centre. One of the plane surfaces is mounted on the black backplane sub-wall 550 such that the rectangular surface typically forms an obtuse angle with a backplane sub-wall 550. The ganged connector grips 920 are pivotally connected to each end of the rectangular surface 930. The ganged connector grips 920 have an inner surface 937 and an outer surface 938. The ganged connector I/O ports 870 are placed on the inner surface 937 of the ganged connector grips 920. The module support stem 910 is attached to the centre of the rectangular surface 930. The module connectors 880 are mounted on the rectangular surface 930. Similarly, the backplane connectors 830 are mounted on the backplane sub-walls 550. The backplane connectors 830 are connected to the module connectors 880 and to the ganged connector I/O ports 870 using short cables (not shown) placed inside the base 900 and the ganged connector grips 920 respectively.

Typically up to three connector blocks are mounted on each backplane sub-wall 550. Ribbon cables 840 are connected to the backplane connectors 830 and run through the ribbon cable holes 580.

Referring to FIGS. 23, 24, 25, 26, 27, 28 and 29 each module 800 typically comprises a housing 995, a module support stem opening 1000, complementary module connectors 1010, status indicators 1020, a release button 1030 cooling fins 1040 and circuitry (not shown). The housing 995 houses the circuitry and has generally the shape of a rectangular parallelepiped (or cuboid) with a back 1042, a front 1043, two sides 1044, 1045, a top 1046 and a bottom 1048. The module support stem opening 1000 is located in the middle of the back 1042 of the housing 995. The complementary module connectors 1010 are mounted on the back 1042 of the housing 995. The status indicators 1020 are generally located where the top 1046 meets the front 1042. The cooling fins 1040 are located on the top 1046 and the bottom 1048 of the housing 995.

Depending on the intended use for the radio communication site, the modules 800 can house different types of circuitry. For example, in cellular radio communication systems, the modules 800 typically house digital controllers for site management, power supplies and backhaul circuitry to carry data and traffic to and from a network controller located off site. The power supplies convert the AC power from the power utility company into DC power typically wired by the communication equipment.

The modules 800 mount on the connector blocks 820. The module support stem 910 slides into the module support stem opening 1000 such that the module connectors 880 mate with the complementary module connectors 1010. A locking mechanism inside the module 800 engages the module support stem 910 to prevent the module 800 from falling out. The two ganged grips 920 are pushed towards the module 800 such that the ganged connectors 860 mate with the ganged connector I/O ports 870.

The module connectors 880 and the complementary module connectors 1010 are typically electrical connectors such as male and female DB 25 or DB 9 connectors.

In order to release the module 800 from the connector block 820, the two ganged connector grips 920 are pushed away from the module 800 and the release button 1030 is pushed. The release button 1030 disengages the locking mechanism and allows the module 800 to slide freely over the module support stem 910.

The cooling fins 1040 help dissipate heat from the modules 800. The heat typically flows over and under the modules 800 and through the convection vents 620. The heat then typically rises by convection inside the hollow mast 100. The cooling typically occurs at the top of the hollow mast 100. The removal of heat by convection can be improved by adding optional air vents in the base 130 and near the upper end 108 of the hollow mast. In addition, an optional fan can be placed inside the base 130 to encourage air flow. Optional insulation can also be placed on the inside surface 132 of the base 130 to reduce the amount of heat generated by sunlight hitting the base 130. The removal of the heat by convection typically eliminates the need for costly cooling systems to maintain proper environmental conditions for the modules 800. In cold climates, heaters can be placed inside the base 130.

Other variations and modifications of the invention are possible. For example, the antennas 170 can be removed from the movable module 120 and fixed near the top 92 of the inner mast 90. In this embodiment, each RF transmission means typically comprise a cable and a connector attached to the movable module 120. Each cable is connected to the respective RF module 180 and to the respective connector. Each antenna 170 further comprises a complementary connector that can mate with the respective connector. When the movable module 120 is in the upper position 160, the connectors mate with the complementary connectors and radio signals are carried from the RF modules 180 to the antennas 170 and vice versa via the respective first RF transmission means. Alternatively, each RF transmission means typically comprise a first RF transmission means and a second RF transmission means. Each first RF transmission means typically comprise a cable and a connector attached to the movable module 120. Each cable is connected to the respective RF module and to the respective connector. Each second RF transmission means typically comprise a second cable and a complementary connector attached to the respective antenna 170. Each second cable is connected to the respective antenna 170 and to the respective complementary connector. When the movable module 120 is in the upper position 160, the connectors mate with the complementary connectors and radio signals are carried from the RF modules 180 to the antennas 170 and vice versa via the first RF transmission means and the second RF transmission means.

Another variation is possible. The RF modules 180 can be removed from the movable module 120 and placed inside the base 130 along with the communications equipment. The first power and traffic transmission means are removed from the inside 102 of the hollow mast 100 and the second power and traffic transmission means are removed from the movable module 120. Power and traffic transmission means are connected between the communications equipment in the base 130 and the RF modules 180 in the base 130. There is typically a separate RF transmission means connecting the respective RF module 180 with the respective antenna 170. Each RF transmission means typically comprise a cable and a connector. The connectors are attached to the support bracket 450 of the antenna top 108. Each cable is connected to the respective RF module 180 housed inside the base 130 and to the respective connector. Each cable is routed between the respective RF module and the respective connector in a manner that does not significantly interfere with the movement of the movable module 120. In one embodiment, each cable is attached at a plurality of locations along the inside surface 122 of a hollow lower mast 104 and the inside surface 126 of the hollow antenna top 108. The locations chosen for each cable are always between the same two ridges 295 in order to ensure that the cable does not significantly interfere with the movement of the movable module 120. Each antenna 170 further comprises a complementary connector that can mate with the respective connector. When the movable module 120 is in the upper position 160, the connectors mate with the complementary connectors and radio signals are carried from the RF modules 180 to the antennas 170 and vice versa via the respective RF transmission means. Alternatively, each RF transmission means typically comprise a first RF transmission means and a second RF transmission means. Each first RF transmission means typically comprise a cable and a connector. The connectors are attached to the support bracket 450 of the antenna top 108. Each cable is connected to the respective RF module 180 housed inside the base 130 and to the respective connector. Each cable is routed between the respective RF module and the respective connector in a manner that does not significantly interfere with the movement of the movable module 120. In another embodiment, each cable is attached at a plurality of locations along the inside surface 122 of a hollow lower mast 104 and the inside surface 126 of the hollow antenna top 108. The locations chosen for each cable are always between the same two ridges 295 in order to ensure that the cable does not significantly interfere with the movement of the movable module 120. Each second RF transmission means typically comprise a short cable and a complementary connector. The short cables are placed inside the respective conduit 210. Each short cable is connected to the respective antenna 170 and to the respective complementary connector. When the movable module 120 is in the upper position, the connectors mate with the complementary connectors and radio signals are carried from the RF modules to the antennas 170 and vice versa via the first RF transmission means and the second RF transmission means.

Variations on the antenna lifting means are possible. For example, the inner mast 90 can be replaced with a telescoping mast with a top and a bottom. The movable module 120 is attached to the top of the telescoping mast. Hydraulic means are typically employed to extend and contract the telescoping mast.

Another variation on the antenna lifting means is possible. A motorized movable module 120 that travels vertically along a circular or more traditional track can be used. In this embodiment, the rotor in the base 130 is eliminated.

Yet another variation on the antenna lifting means is possible. The thread on the threaded carrier 240 and the complementary thread on the inner mast are eliminated. Instead a cable track system similar to the type used in elevators is used. A motor and spool system is placed inside the base 130. A pulley is attached to the hollow antenna mast 100 or to the inner mast 90 near the top 92 of the inner mast 90. Cable is connected to the motor and spool system, runs through the pulley and is connected to the movable module 120. The motor and spool system lifts the movable module 120 towards the upper position 160 by spooling the cable and moves the movable module 120 to the lower position 150 by unwinding the cable.

Variations on the movable module 120 are possible. More than three or fewer than three antennas 170 and RF modules 180 can be attached to the movable module 120.

Variations on the first power and traffic transmission means and the power and traffic transmission means are possible. For example, instead of the cable 410 being attached to the inside of the hollow mast 100, the cable 410 can dangle from the movable module. A motorized cable spool system typically located inside the base 130 can be used to prevent the cable 410 from interfering with the movement of the movable module 120. The motorized cable spool system can wind the cable 410 when the movable module 120 is being moved toward the lower position 150 and unwind the cable when the movable module 120 is being moved toward the upper position 160.

Similarly, variations on the first RF transmission means and the RF transmission means used in the embodiments of the invention in which the RF modules 180 removed from the movable module 120 and placed in the base 130 are possible. For example, instead of the cable being attached to the inside of the hollow mast 100, the cable can dangle from the movable module. A motorized cable spool system typically located inside the base 130 can be used to prevent the cable from interfering with the movement of the movable module 120. The motorized cable spool system can wind the cable when the movable module 120 is being moved toward the lower position 150 and unwind the cable when the movable module 120 is being moved toward the upper position 160.

Variations on the comminations equipment are possible. For example, instead of the using modules 800, traditional common equipment cards oriented vertically and cooled by fans can be used. Alternatively, the modules 800 can be oriented vertically with fans below the modules.

Moreover, variations on the communication assemblies 810 are possible. For example, fibre optic backplanes can be used.

Furthermore, the communications equipment can be placed outside the antenna structure 85 and placed in an environmentally controlled hut.

We claim:

1. An antenna structure comprising, in combination:

a hollow antenna mast having an inside and an outside;

a movable module having at least one antenna, at least one RF module and at least one RF transmission means connected to the at least one antenna and the at least one RF module, said movable module being disposed inside said hollow antenna mast; and, lifting means;

wherein said lifting means permit the raising and lowering of said movable module inside said hollow antenna mast between a lower position and an upper position.

2. An antenna structure according to claim 1 wherein the hollow antenna mast comprises:

a hollow lower antenna mast having an open top and an open bottom; and, a hollow antenna top having an open bottom and a closed top;

wherein the bottom of the hollow antenna top is attached to the top of the hollow lower antenna mast;

and wherein the hollow antenna top does not significantly attenuate the passage of radio signals.

3. An antenna structure according to claim 2 further comprising power and traffic transmission means connected to the at least one RF module in a manner that does not significantly interfere with the movement of the movable module.

4. An antenna structure according to claim 3 further comprising a motorized spool system having a motor and a spool connected to the motor;

wherein the motorized spool system is disposed near the bottom of the hollow antenna mast;

and wherein the motorized spool system winds the power and traffic transmission means on the spool during the lowering of the movable module and unwinds the power and traffic transmission means during the raising of the movable module.

5. An antenna structure according to claim 2 further comprising first power and traffic transmission means attached to the hollow antenna mast in a manner that does not interfere with the movement of the movable module;

and wherein when the movable module is in the upper position, the first power and traffic transmission means mate with the movable module and carry power and traffic to the movable module and carry traffic away from the movable module.

6. An antenna structure according to claim 5 wherein the movable module comprises:

a carriage wherein the at least one antenna is attached to the carriage and the at least one RF module is attached to the carriage; and, at least one second power and traffic transmission means attached to said carriage and connected to the at least one RF module wherein the at least one second power and traffic transmission means mate with the first power and traffic transmission means when the movable module is in the upper position.

7. An antenna structure according to claim 6 wherein the lifting means comprise:

an inner mast with a thread, said inner mast being placed inside the hollow antenna mast; and, a rotor attached to the inner mast;

and wherein the carriage further comprises:

rotation prevention means; and, a threaded carrier, said threaded carrier having a complementary thread that cooperatively engages the thread on the inner mast;

and wherein the rotor turns the inner mast in a direction causing the carriage to move up the inner mast and turns the inner mast in an opposite direction causing the carriage to move down the inner mast.

8. An antenna structure according to claim 7 wherein the rotation prevention means comprise:

a plurality of struts with guide wheels, said struts attached to the carriage;

biasing means; and ridges placed inside said hollow antenna mast;

wherein said biasing means forces the guide wheels to cooperatively engage the ridges.

9. An antenna structure according to claim 6 wherein the carriage further comprises roller means which cooperatively engage said hollow antenna mast and the lifting means comprise:

an inner mast with a top and a bottom, said inner mast being placed inside the hollow antenna mast;

pulley means attached to the hollow antenna mast or the inner mast near the top of said inner mast;

a motor and spool system comprising a motor and a spool connected to the motor, said motor and spool system disposed in the base; and, cable running through the pulley means and attached to the movable module and to the motor and spool system;

wherein the lifting means raise the movable module by winding the cable on the spool and lower the movable module by unwinding the cable on the spool.

10. An antenna structure according to claim 6 wherein the lifting means comprises:

an telescoping inner mast, said telescoping inner mast being placed inside the hollow antenna mast; and hydraulic means connected to the telescoping inner mast;

wherein the movable module is attached to the telescoping inner mast;

and wherein the hydraulic means cause the telescoping inner mast to extend and cause the telescoping inner mast to contract.

11. An antenna structure according to claim 8 further comprising communications equipment connected to the power and traffic transmission means.

12. An antenna structure according to claim 11 wherein the communications equipment is connect ed to a network.

13. An antenna structure according to claim 12 wherein the communications equipment is placed inside the hollow lower antenna mast.

14. An antenna structure according to claim 11 wherein the hollow antenna mast further comprises a base having an inside and an outside and wherein the bottom of the hollow lower antenna mast is attached to the base.

15. An antenna structure according to claim 14 wherein the communications equipment is placed inside the base.

16. An antenna structure according to claim 15 wherein the base has at least one door.

17. An antenna structure according to claim 16 wherein the base has a plurality of ventilation openings which permit heat generated by the communications equipment to rise inside the hollow antenna mast.

18. An antenna structure according to claim 17 wherein there are three antennas and three RF modules.

19. An antenna structure according to claim 18 wherein the communications equipment comprises:

a plurality of module assemblies with connector blocks, said connector blocks attached to the inside of the base; and, a plurality of modules connected to the connector blocks.

20. An antenna structure comprising, in combination:

a hollow antenna mast having an inside and an outside;

at least; one antenna attached to the hollow antenna mast;

a movable module having at least one RF module, said movable module being disposed inside said hollow antenna mast;

RF transmission means connected to the at least one RF module; and, lifting means;

wherein said lifting means permit the raising and lowering of said movable module inside said hollow antenna mast between a lower position and an upper position;

and wherein when the movable module is in the upper position, the RF transmission means mate with the at least on antenna.

21. An antenna structure according to claim 20 wherein the hollow antenna mast comprises:

a hollow lower antenna mast having an open top and an open bottom; and, a hollow antenna top having an open bottom and a closed top;

wherein the bottom of the hollow antenna top is attached to the top of the hollow lower antenna;

and wherein the hollow antenna top does not significantly attenuate the passage of radio signals.

22. An antenna structure according to claim 21 wherein power and traffic transmission means are connected to the at least one RF module in a manner that does not significantly interfere with the movement of the movable module.

23. An antenna structure according to claim 22 further comprising a motorized spool system having a motor and a spool connected to the motor;

wherein the motorized spool system is disposed near the bottom of the hollow antenna mast;

and wherein the motorized spool system winds the power and traffic transmission means on the spool during the lowering of the movable module and unwinds the power and traffic transmission means during the raising of the movable module.

24. An antenna structure according to claim 21 further comprising first power and traffic transmission means attached to the hollow antenna mast in a manner that does not interfere with the movement of the movable module;

and wherein when the movable module is in the upper position, the first power and traffic transmission means mate with the movable module and carry power and traffic to the movable module and carry traffic away from the movable module.

25. An antenna structure according to claim 24 wherein the movable module comprises:

a carriage wherein the at least one antenna is attached to the carriage and the at least one RF module is attached to the carriage; and, at least one second power and traffic transmission means attached to said carriage and connected to the at least one RF module;

wherein the at least one second power and traffic transmission means mate with the first power and traffic transmission means when the movable module is in the upper position.

26. An antenna structure according to claim 25 wherein the lifting means comprise:

an inner mast with a thread, said inner mast being placed inside the hollow antenna mast; and, a rotor attached to the inner mast;

and wherein the carriage further comprises:

rotation prevention means; and, a threaded carrier; said threaded carrier having a complementary thread that cooperatively engages the thread on the inner mast;

and wherein the rotor turns the inner mast in a direction causing the carriage to move up the inner mast and turns the inner mast in an opposite direction causing the carriage to move down the inner mast.

27. An antenna structure according to claim 26 wherein the rotation prevention means comprise:

a plurality of struts with guide wheels, said struts attached to the movable module;

biasing means; and ridges placed inside said hollow antenna mast;

wherein said biasing means forces the guide wheels to cooperatively engage the ridges.

28. An antenna structure according to claim 25 wherein the carriage further comprises roller means which cooperatively engage said hollow antenna mast and the lifting means comprise:

an inner mast with a top and a bottom, said inner mast being placed inside the hollow antenna mast;

pulley means attached to the hollow antenna mast or the inner mast near the top of said inner mast;

a motor and spool system comprising a motor and a spool connected to the motor, said motor and spool system disposed in the base; and, cable running through the pulley means and attached to the movable module and to the motor and spool system;

wherein the lifting means raise the movable module by winding the cable on the spool and lower the movable module by unwinding the cable on the spool.

29. An antenna structure according to claim 25 wherein the lifting means comprises:

an telescoping inner mast, said telescoping inner mast being placed inside the hollow antenna mast; and, hydraulic means connected to the telescoping inner mast;

wherein the movable module is attached to the telescoping inner mast;

and wherein the hydraulic means cause the telescoping inner mast to extend and cause the telescoping inner mast to contract.

30. An antenna structure according to claim 27 further comprising communications equipment connected to the power and traffic transmission means.

31. An antenna structure according to claim 30 wherein the communications equipment is connected to a network.

32. An antenna structure according to claim 31 wherein the communications equipment is placed inside the hollow lower antenna mast.

33. An antenna structure according to claim 30 wherein the hollow antenna mast further comprises a base having an inside and an outside and wherein the bottom of the hollow lower antenna mast is attached to the base.

34. An antenna structure according to claim 33 wherein the communications equipment is placed inside the base.

35. An antenna structure according to claim 34 wherein the base has at least one door.

36. An antenna structure according to claim 35 wherein the base has a plurality of ventilation openings which permit heat generated by the communications equipment to rise inside the hollow antenna mast.

37. An antenna structure according to claim 36 wherein there are three antennas, three RF modules and three RF transmission means.

38. An antenna structure according to claim 36 wherein the communications equipment comprises:

a plurality of module assemblies with connector blocks, said connector blocks attached to the inside of the base; and, a plurality of modules connected to the connector blocks.

39. An antenna structure comprising, in combination:

a hollow antenna mast having an inside and an outside;

a movable module having at least one antenna, said movable module being disposed inside said hollow antenna mast; and, lifting means;

wherein said lifting means permit the raising and lowering of said movable module inside the hollow antenna mast between a lower position and an upper position.

40. An antenna structure according to claim 39 wherein the hollow antenna mast comprises:

a hollow lower antenna mast having an open top and an open bottom; and, a hollow antenna top having an open bottom and a closed top;

wherein the bottom of the hollow antenna top is attached to the top of the hollow lower antenna;

and wherein the hollow antenna top does not significantly attenuate the passage of radio signals.

41. An antenna structure according to claim 40 further comprising at least one RF transmission means connected to the at least one antenna in a manner that does not significantly interfere with the movement of the movable module.

42. An antenna structure according to claim 41 further comprising a motorized spool system having a motor and a spool connected to the motor;

wherein the motorized spool system is disposed near the bottom of the hollow antenna mast;

and wherein the motorized spool system winds the at least one RF transmission means on the spool during the lowering of the movable module and unwinds the at least one RF transmission means during the raising of the movable module.

43. An antenna structure according to claim 40 further comprising at least one first RF transmission means attached to the hollow antenna mast in a manner that does not interfere with the movement of the movable module;

and wherein when the movable module is in the upper position, the at least one first RF transmission means mate with the at least one antenna and carry radio signals to and from the at least one antenna.

44. An antenna structure according to claim 43 wherein the movable module comprises:

a carriage wherein the at least one antenna is attached to the carriage; and, at least one second RF transmission means attached to said carriage and connected to the at least one antenna wherein the at least one second RF transmission means mate with the at least one first RF transmission means when the movable module is in the upper position.

45. An antenna structure according to claim 44 wherein the lifting means comprise:

an inner mast with a thread, said inner mast being placed inside the hollow antenna mast; and, a rotor attached to the inner mast;

and wherein the carriage further comprises:

rotation prevention means; and, a threaded carrier, said threaded carrier having a complementary thread that cooperatively engages the thread on the inner mast;

and wherein the rotor turns the inner mast in a direction causing the carriage to move up the inner mast and turns the inner mast in an opposite direction causing the carriage to move down the inner mast.

46. An antenna structure according to claim 45 wherein the rotation prevention means comprise:

a plurality of struts with guide wheels, said struts attached to the movable module;

biasing means; and ridges placed inside said hollow antenna mast;

wherein said biasing means forces the guide wheels to cooperatively engage the ridges.

47. An antenna structure according to claim 44 wherein the carriage further comprises roller means which cooperatively engage said hollow antenna mast and the lifting means comprise:

an inner mast with a top and a bottom, said inner mast being placed inside the hollow antenna mast;

pulley means attached to the hollow antenna mast or the inner mast near the top of said inner mast;

a motor and spool system comprising a motor and a spool connected to the motor, said motor and spool system disposed in the base; and, cable running through the pulley means and attached to the movable module and to the motor and spool system;

wherein the lifting means raise the movable module by winding the cable on the spool and lower the movable module by unwinding the cable on the spool.

48. An antenna structure according to claim 44 wherein the lifting means comprises:

an telescoping inner mast, said telescoping inner mast being placed inside the hollow antenna mast; and, hydraulic means connected to the telescoping inner mast, wherein the movable module is attached to the telescoping inner mast;

and wherein the hydraulic means cause the telescoping inner mast to extend and cause the telescoping inner mast to contract.

49. An antenna structure according to claim 46 further comprising at least one RF module connected to the at least one RF transmission means.

50. An antenna structure according to claim 49 further comprising communications equipment connected to the at least one RF module.

51. An antenna structure according to claim 50 wherein at least one RF module is placed inside the hollow lower antenna mast.

52. An antenna structure according to claim 51 wherein the communications equipment is connected to a network.

53. An antenna structure according to claim 50 wherein the hollow antenna mast further comprises a base having an inside and an outside and wherein the bottom of the hollow lower antenna mast is attached to the base.

54. An antenna structure according to claim 53 wherein the at least one RF module and the communications equipment are placed inside the base.

55. An antenna structure according to claim 54 wherein the base has at least one door.

56. An antenna structure according to claim 55 wherein the base has a plurality of ventilation openings which permit heat generated by the communications equipment and the at least one RF module to rise inside the hollow antenna mast.

57. An antenna structure according to claim 56 wherein there are three antennas and three RF modules.

58. An antenna structure according to claim 57 wherein the communications equipment comprises:

a plurality of module assemblies with connector blocks, said connector blocks attached to the inside of the base; and, a plurality of modules connected to the connector blocks.

* * * * *